US010421643B2

(12) United States Patent
Mori

(10) Patent No.: US 10,421,643 B2
(45) Date of Patent: Sep. 24, 2019

(54) PASSENGER CONVEYOR

(71) Applicant: MITSUBISHI ELECTRIC CORPORATION, Chiyoda-ku (JP)

(72) Inventor: Keisuke Mori, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 0 days.

(21) Appl. No.: 15/779,867

(22) PCT Filed: Oct. 21, 2016

(86) PCT No.: PCT/JP2016/081254
§ 371 (c)(1),
(2) Date: May 30, 2018

(87) PCT Pub. No.: WO2017/126177
PCT Pub. Date: Jul. 27, 2017

(65) Prior Publication Data

US 2018/0354755 A1 Dec. 13, 2018

(30) Foreign Application Priority Data

Jan. 21, 2016 (JP) ..... 2016-009708

(51) Int. Cl.
*B66B 23/00* (2006.01)
*B66B 25/00* (2006.01)
*B66B 29/00* (2006.01)

(52) U.S. Cl.
CPC ..... *B66B 23/00* (2013.01); *B66B 25/00* (2013.01); *B66B 29/00* (2013.01)

(58) Field of Classification Search
CPC ..... B66B 23/00; B66B 25/00; B66B 29/00
(Continued)

(56) References Cited

U.S. PATENT DOCUMENTS 4,260,318 A * 4/1981 Holritz ..... B66B 21/02 414/589
4,811,829 A * 3/1989 Nakazawa ..... B66B 23/00 198/326

(Continued)

FOREIGN PATENT DOCUMENTS

JP 2011-063389 A 3/2011
JP 2014-136609 A 7/2014
JP 2015-078021 A 4/2015

OTHER PUBLICATIONS

International Search Report dated Jan. 10, 2017 in PCT/JP2016/081254, filed on Oct. 21, 2016.

*Primary Examiner* — Douglas A Hess
(74) *Attorney, Agent, or Firm* — Oblon, McClelland, Maier & Neustadt, L.L.P.

(57) ABSTRACT

A passenger conveyor includes a semi-fixing mechanism, which restrains movement of a truss in a direction toward one floor and releases the restraint of the movement of the truss in the direction toward the one floor, and a truss-position recovery mechanism, which moves the truss in the longitudinal direction with respect to the one floor to set a dimension between the truss and the one floor to a preset specified dimension before the truss is moved in the longitudinal direction with respect to another floor when a separating force in a direction in which the truss is separated from the one floor is exerted between the truss and the one floor after the restraint of the movement of the truss in the direction toward the one floor is released.

13 Claims, 19 Drawing Sheets

(58) Field of Classification Search
USPC ..... 198/321, 322, 323, 324
See application file for complete search history.

(56) References Cited

U.S. PATENT DOCUMENTS

| | | | | | |
|---|---|---|---|---|---|
| 5,697,487 | A * | 12/1997 | Engelke | B66B 23/10 | 198/326 |
| 6,129,198 | A * | 10/2000 | Nusime | B66B 23/00 | 198/321 |
| 6,247,574 | B1 * | 6/2001 | Yamaguchi | B66B 21/00 | 198/326 |
| 6,637,580 | B1 * | 10/2003 | Sneed | B65G 21/00 | 198/326 |
| 8,950,568 | B2 * | 2/2015 | Casielles Estrada | B66B 23/147 | 198/324 |
| 9,254,986 | B2 * | 2/2016 | Inoue | B66B 21/02 | |
| 9,834,416 | B2 * | 12/2017 | Krampl | B66B 23/00 | |
| 10,046,950 | B2 * | 8/2018 | Nawata | B66B 21/02 | |
| 10,085,676 | B1 * | 10/2018 | Berme | A61B 5/112 | |
| 2018/0208440 | A1 * | 7/2018 | Landsbeck et al. | | |

* cited by examiner

FIG.20

| | | FRICTION COEFFICIENT | | | | | | | | | |
|---|---|---|---|---|---|---|---|---|---|---|---|
| | | 0.1 | 0.2 | 0.3 | 0.4 | 0.5 | 0.6 | 0.7 | 0.8 | 0.9 | 1 |
| ANGLE [DEGREE] | 0 | – | – | – | – | – | – | – | – | – | – |
| | 10 | 667 | – | – | – | – | – | – | – | – | – |
| | 20 | 196 | 327 | 867 | – | – | – | – | – | – | – |
| | 30 | 111 | 148 | 212 | 347 | 833 | – | – | – | – | – |
| | 40 | 73 | 91 | 116 | 152 | 209 | 314 | 571 | 2137 | – | – |
| | 50 | 51 | 62 | 76 | 93 | 115 | 145 | 186 | 249 | 355 | 572 |
| | 60 | 36 | 44 | 53 | 64 | 76 | 90 | 107 | 128 | 154 | 187 |
| | 70 | 24 | 30 | 37 | 45 | 53 | 62 | 71 | 82 | 94 | 107 |
| | 80 | 14 | 20 | 25 | 31 | 37 | 43 | 50 | 57 | 64 | 71 |

PASSENGER CONVEYOR

TECHNICAL FIELD

The present invention relates to a passenger conveyor including a truss supported on a building through intermediation of support fittings.

BACKGROUND ART

A truss of an escalator is installed so as to bridge floors which are separate from each other in a height direction and a horizontal direction. Support fittings each being made of angle steel are provided to both end portions of the truss, and one end portion or both end portions of the truss are supported on the floor in an unfixed state of being slidable in a longitudinal direction of the truss with respect to the floor. In the escalator described above, the support fitting provided on an unfixed side of the truss moves relative to a backup plate provided to the floor. Hence, for example, when an earthquake occurs, generation of a large stress between the truss and the backup plate is prevented. Therefore, when a building shakes in a direction in which a dimension between the floors increases due to the earthquake, the truss is prevented from falling off the floor by sufficiently ensuring an overlap allowance being a length of a portion of the support fitting, which is in contact with the backup plate. Further, when the building shakes in a direction in which the dimension between the floors is reduced due to the earthquake, compression of the truss in the longitudinal direction is prevented by sufficiently ensuring a clearance between the truss and the floor.

The support fittings are members which support a full weight of the escalator. Therefore, when the clearance between the truss and the floor is large, a load exerted on the support fittings increases. Thus, for the truss having one fixed end, which ensures the clearance between the truss and the floor only at one longitudinal end portion of the truss, it is difficult to provide a clearance which is sufficient to cope with a change in dimension between the floors generated at the time of occurrence of a large-scale earthquake. The truss having both unfixed ends, which ensures the clearance between the truss and the floor at each of the both longitudinal end portions of the truss, can cope with a change in dimension between the floors, which is generated at the time of occurrence of an earthquake, with the sum of the clearances between the both longitudinal end portions of the truss and the respective floors, and therefore, can cope with the change in dimension between the floors generated at the time of occurrence of a large-scale earthquake. However, the both longitudinal end portions of the truss are not fixed to the respective floors. Thus, even at the time of occurrence of a small-scale earthquake, the escalator is positionally shifted with respect to the floors.

Therefore, hitherto, there has been known an escalator including a pivot support member provided upright on the backup plate and the support fitting fixed to the truss, which are engaged with each other, which copes with the change in dimension between the floors by breakage of the pivot support member at the time of occurrence of a large-scale earthquake (see, for example, Patent Literature 1).

CITATION LIST

Patent Literature

[PTL 1] JP 2015-78021 A

SUMMARY OF INVENTION

Technical Problem

The positional shift can be prevented at the time of occurrence of the small-scale earthquake, and the change in dimension between the floors can be coped with at the time of occurrence of the large-scale earthquake. After the large-scale earthquake occurs and the pivot support member breaks, however, the escalator is positionally shifted with respect to the floors. As a result, for recovery after the occurrence of the large-scale earthquake, there is a problem in that the escalator is required to be lifted up by means of a crane or other machines to be returned back to an original position.

The present invention has been made to provide a passenger conveyor capable of automatically returning to an original position with respect to floors after occurrence of a large-scale earthquake.

Solution to Problem

According to one embodiment of the present invention, there is provided a passenger conveyor to be supported on one floor of a building through intermediation of one support fitting provided to one longitudinal end portion of a truss and to be supported on another floor of the building through intermediation of another support fitting provided to another longitudinal end portion of the truss, the passenger conveyor including: a semi-fixing mechanism, which restrains movement of the truss in a direction toward the one floor when a magnitude of an approaching force exerted between the truss and the one floor in a direction in which the truss is moved toward the one floor is smaller than a preset specified value and releases the restraint of the movement of the truss in the direction toward the one floor when the magnitude of the approaching force is equal to or larger than the preset specified value; and a truss-position recovery mechanism, which moves the truss in the longitudinal direction with respect to the one floor to set a dimension between the truss and the one floor to a preset specified dimension before the truss is moved in the longitudinal direction with respect to the another floor when a separating force in a direction in which the truss is separated from the one floor is exerted between the truss and the one floor after the restraint of the movement of the truss in the direction toward the one floor is released.

Advantageous Effects of Invention

The passenger conveyor according to the present invention includes the truss-position recovery mechanism which moves the truss in the longitudinal direction with respect to the one floor to set the dimension between the truss and the one floor to the specified dimension before the truss is moved in the longitudinal direction with respect to the another floor when the dimension between the truss and the one floor is smaller than the specified dimension after the restraint of movement of the truss in the direction toward the one floor is released and the separating force being the force in the direction in which the truss is separated from the one floor is exerted between the truss and the one floor. Thus, the truss can automatically return to the original position with respect to the floors after occurrence of a large-scale earthquake.

BRIEF DESCRIPTION OF DRAWINGS

FIG. 20 is a table for showing results of calculations of a relationship between a friction coefficient $\mu$ and an inclination angle $\theta$ when a self-weight mg of the truss is defined as 100 kN.

DESCRIPTION OF EMBODIMENTS

First Embodiment

Figure 1:
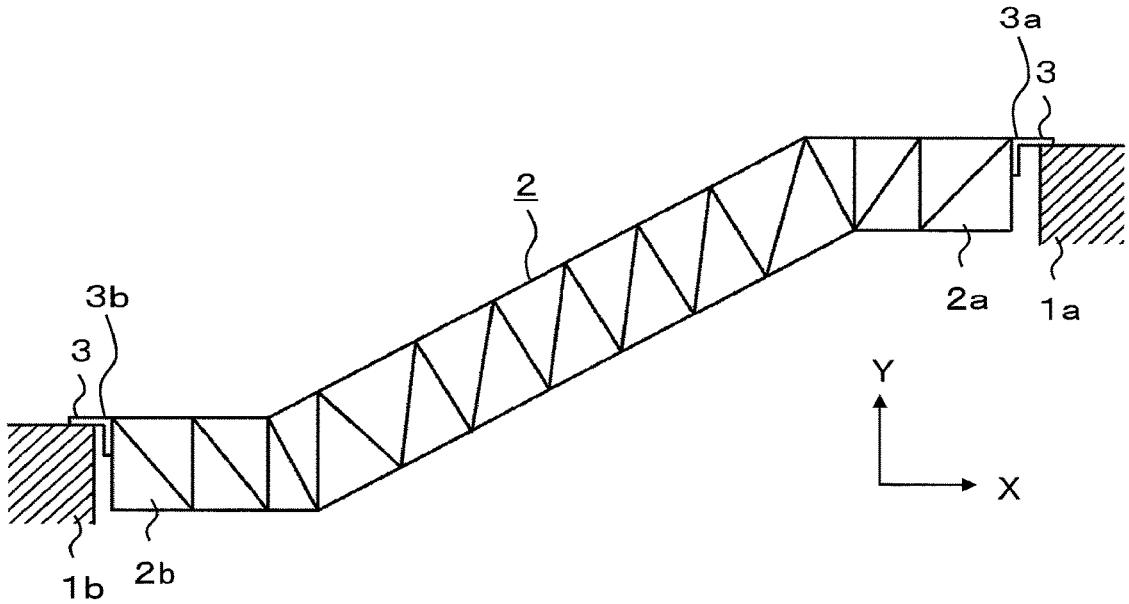
FIG. 1 is a side view for illustrating a main part of an escalator according to a first embodiment of the present invention.

FIG. 1 is a side view for illustrating a main part of an escalator according to a first embodiment of the present invention. In the first embodiment, an escalator is described as a passenger conveyor. In FIG. 1, the escalator is provided to bridge an upper-side floor 1*a* being one floor in a building and a lower-side floor 1*b* being another floor in the building. A truss 2 is constructed of a beam made of a steel material. A pair of support fittings 3 each being made of angle steel is provided to both longitudinal end portions of the truss 2. In the first embodiment, a portion of the both longitudinal end portions of the truss 2, which is located on the upper-side floor 1*a* side, is defined as one longitudinal end portion 2*a*, whereas a portion of the both longitudinal end portions of the truss 2, which is located on the lower-side floor 1*b* side, is defined as another longitudinal end portion 2*b*. Further, one support fitting being the support fitting 3 of the pair of support fittings 3, which is to be fixed to the one longitudinal end portion 2*a*, is defined as a support fitting 3*a*, whereas another support fitting being the support fitting 3 of the pair of support fittings 3, which is to be fixed to the another longitudinal end portion 2*b*, is defined as a support fitting 3*b*. Therefore, the escalator is supported on the upper-side floor 1*a* through intermediation of the support fitting 3*a* provided to the one longitudinal end portion 2*a*, and is supported on the lower-side floor 1*b* through intermediation of the support fitting 3*b* provided to the another longitudinal end portion 2*b*. In the first embodiment, the "longitudinal direction" is a longitudinal direction of the truss 2 when the truss 2 is viewed from above and is a direction indicated by the arrow X in FIG. 1. Further, in the first embodiment, the "height direction" is a height direction of the truss 2 when the truss 2 is viewed from a lateral direction and is a direction indicated by the arrow Y in FIG. 1.

The escalator includes a semi-fixing mechanism which restrains movement of the truss 2 in a direction toward the upper-side floor 1*a* to maintain a dimension between the truss 2 and the upper-side floor 1*a* to a preset specified dimension when an approaching force being a force in a direction in which the truss 2 is moved toward the upper-side floor 1*a* is exerted between the truss 2 and the upper-side floor 1*a* and a magnitude of the approaching force is smaller than a preset specified value, and to release the restraint of movement of the truss 2 in the direction toward the upper-side floor 1*a* when the magnitude of the approaching force is equal to or larger than the specified value.

Further, the escalator includes a truss-position recovery mechanism which causes the truss 2 to move in the longitudinal direction with respect to the upper-side floor 1*a* to set the dimension between the truss 2 and the upper-side floor 1*a* to the specified dimension before the truss 2 is moved in the longitudinal direction with respect to the lower-side floor 1*b* when the dimension between the truss 2 and the upper-side floor 1*a* is smaller than the specified dimension after the restraint of movement of the truss 2 in the direction toward the upper-side floor 1*a* is released and a separating force being a force in which the truss 2 is separated from the upper-side floor 1*a* is exerted between the truss 2 and the upper-side floor 1*a*.

Figure 2:
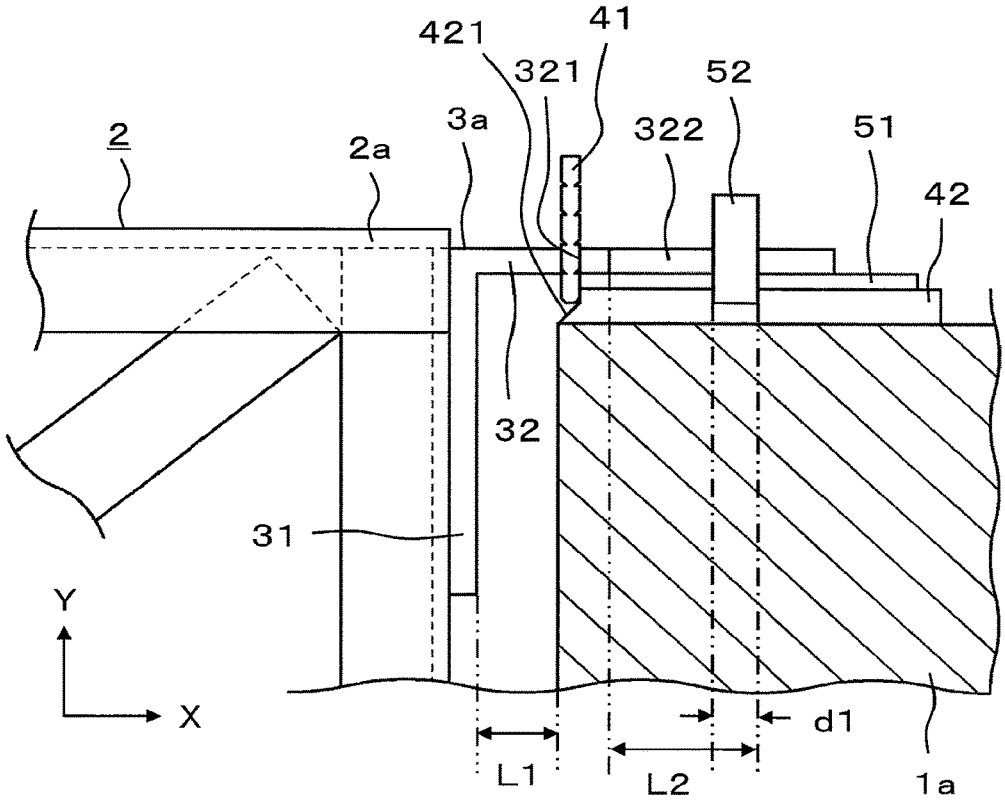
FIG. 2 is an enlarged view for illustrating an upper floor-side part of the escalator illustrated in FIG. 1.
Figure 3:
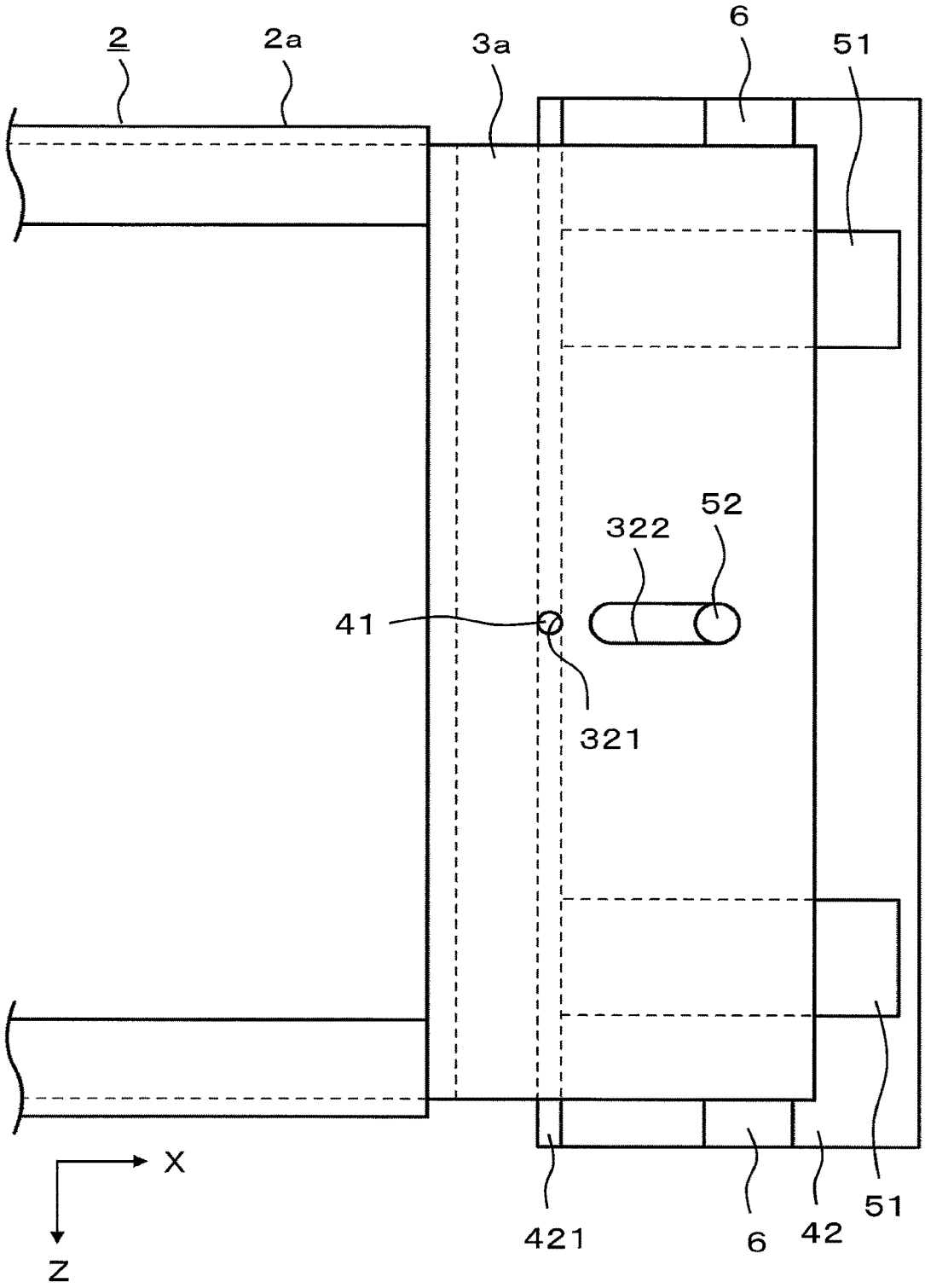
FIG. 3 is a plan view for illustrating the upper floor-side part of the escalator illustrated in FIG. 2.

FIG. 2 is an enlarged view for illustrating an upper floor-side part of the escalator illustrated in FIG. 1, and FIG. 3 is a plan view for illustrating the upper floor-side part of the escalator illustrated in FIG. 2. The support fitting 3*a* includes a longitudinal plate portion 31 which is fixed to a longitudinally outwardly oriented surface of the one longitudinal end portion 2*a* and extends in the height direction and a lateral plate portion 32 which extends outward in the longitudinal direction of the truss 2 from an upper portion of the longitudinal plate portion 31. The longitudinal plate portion 31 is arranged so as to be opposed to the upper-side floor 1*a* in the longitudinal direction of the truss 2.

A semi-fixing pin hole 321 is formed in the lateral plate portion 32 of the support fitting 3*a* so as to pass through the lateral plate portion 32 in the height direction. Further, an elongated hole 322 is formed in the lateral plate portion 32 of the support fitting 3*a* so as to pass through the lateral plate portion 32 in the height direction. The elongated hole 322 is arranged so as to extend in the longitudinal direction of the truss 2 as viewed from above. The elongated hole 322 is arranged on an outer side of the truss 2 in the longitudinal direction with respect to the semi-fixing pin hole 321. The semi-fixing pin hole 321 and the elongated hole 322 are arranged so as to be adjacent to each other in the longitudinal direction of the truss 2. In other words, the semi-fixing pin hole 321 and the elongated hole 322 are arranged at the same position in a width direction. In the first embodiment, the "width direction" is a width direction of the truss 2 when the truss 2 is viewed from above and is a direction indicated by the arrow Z in FIG. 3.

The semi-fixing mechanism includes a semi-fixing pin 41 which is inserted into the semi-fixing pin hole 321 to restrain the movement of the truss 2 toward the upper-side floor 1*a* and a backup plate 42 which is fixed to the upper-side floor 1*a* at a position lower than the semi-fixing pin hole 321 and has an inclined surface 421 inclined with respect to a horizontal plane.

The semi-fixing pin 41 is supported on the backup plate 42 by abutment of a lower end portion of the semi-fixing pin 41 against the inclined surface 421. The semi-fixing pin 41 is formed into a columnar shape. A radial dimension of the semi-fixing pin 41 is slightly smaller than a radial dimension of the semi-fixing pin hole 321. Therefore, the semi-fixing pin 41 is movable in the height direction with respect to the backup plate 42 in a state of being inserted into the semi-fixing pin hole 321.

The backup plate 42 is fixed onto an upper surface of the upper-side floor 1*a*. The inclined surface 421 is formed at an end portion of the backup plate 42 on the truss 2 side. The inclined surface 421 is inclined with respect to the horizontal plane so as to be gradually separated from the truss in an upward direction.

The truss-position recovery mechanism includes a pair of sliding members 51 which is provided between the backup plate 42 and the lateral plate portion 32 of the support fitting 3*a* and an anchor pin 52 which is fixed to the upper-side floor 1*a* and is inserted into the elongated hole 322.

The pair of sliding members 51 is arranged so as to be separated from each other in the width direction. The sliding members 51 are arranged so as to extend in the longitudinal direction of the truss 2. The sliding members 51 are fixed onto an upper surface of the backup plate 42. The lateral plate portion 32 of the support fitting 3*a* is placed on upper surfaces of the sliding members 51. The support fitting 3*a* is slidable in the longitudinal direction of the truss 2 with respect to the upper surfaces of the sliding members 51.

The anchor pin 52 is formed into a columnar shape. A radial dimension of the anchor pin 52 is slightly smaller than a dimension of the elongated hole 322 in the width direction. Therefore, the anchor pin 52 is movable in the longitudinal direction by a longitudinal dimension of the elongated hole 322 in a state of being inserted into the elongated hole 322. A lower end portion of the anchor pin 52 passes through the sliding members 51 to be driven into the backup plate 42 from an upper side. By fixing the anchor pin 52 to the backup plate 42, the anchor pin 52 is fixed to the upper-side floor 1*a*.

A pair of width-direction fasteners 6 is fixed to the backup plate 42. The pair of width-direction fasteners 6 is arranged on an outer side of the support fitting 3*a* in the width direction. The pair of width-direction fasteners 6 restrains movement of the support fitting 3*a* in the width direction. Specifically, the pair of width-direction fasteners 6 guides the support fitting 3*a* in the longitudinal direction of the truss 2. As a result, the movement of the one longitudinal end portion 2*a* in the width direction is restrained.

The sum of a dimension L1 between the longitudinal plate portion 31 of the support fitting 3*a* and the upper-side floor 1*a* and a dimension between a longitudinal plate portion of the support fitting 3*b* and the lower-side floor 1*b* is sufficiently large and therefore prevents the longitudinal plate portion 31 of the support fitting 3*a* and the upper-side floor 1*a* from coming into contact with each other even when a large-scale earthquake occurs. When the anchor pin 52 and a portion of an inner wall of the elongated hole 322, which is located on the truss 2 side, come into contact with each other, a compressive force is undesirably generated in the truss 2. Therefore, a longitudinal dimension L2 of the elongated hole 322 is set larger than the sum of a diameter dl of the anchor pin 52 and the longitudinal dimension L1 between the longitudinal plate portion 31 of the support fitting 3*a* and the upper-side floor 1*a* so as to prevent the contact between the anchor pin 52 and the portion of the inner wall of the elongated hole 322, which is located on the truss 2 side. A dimension between the truss 2 and the upper-side floor 1*a* when the anchor pin 52 is held in contact with a portion of the inner wall of the elongated hole 322, which is the farthest from the truss 2, is defined as a specified dimension. When a dimension between the truss 2 and the upper-side floor 1*a* is the specified dimension, the semi-fixing pin hole 321 is arranged at an upper portion of the inclined surface 421 of the backup plate 42.

The anchor pin 52 is designed to have such a strength as to prevent breakage even when a frictional force generated during the movement of the truss 2 in the longitudinal direction with respect to the lower-side floor 1*b* and an inertia force of the truss 2 generated at the time of occurrence of an earthquake are exerted on the anchor pin 52. The frictional force is calculated from a weight of the escalator and a friction coefficient of the backup plate 42 or the sliding members 51, whereas the inertia force is calculated from the weight of the escalator and a standard horizontal seismic coefficient defined in Notice No. 1046 of Japanese Ministry of Land, Infrastructure, Transport and Tourism.

Figure 4:
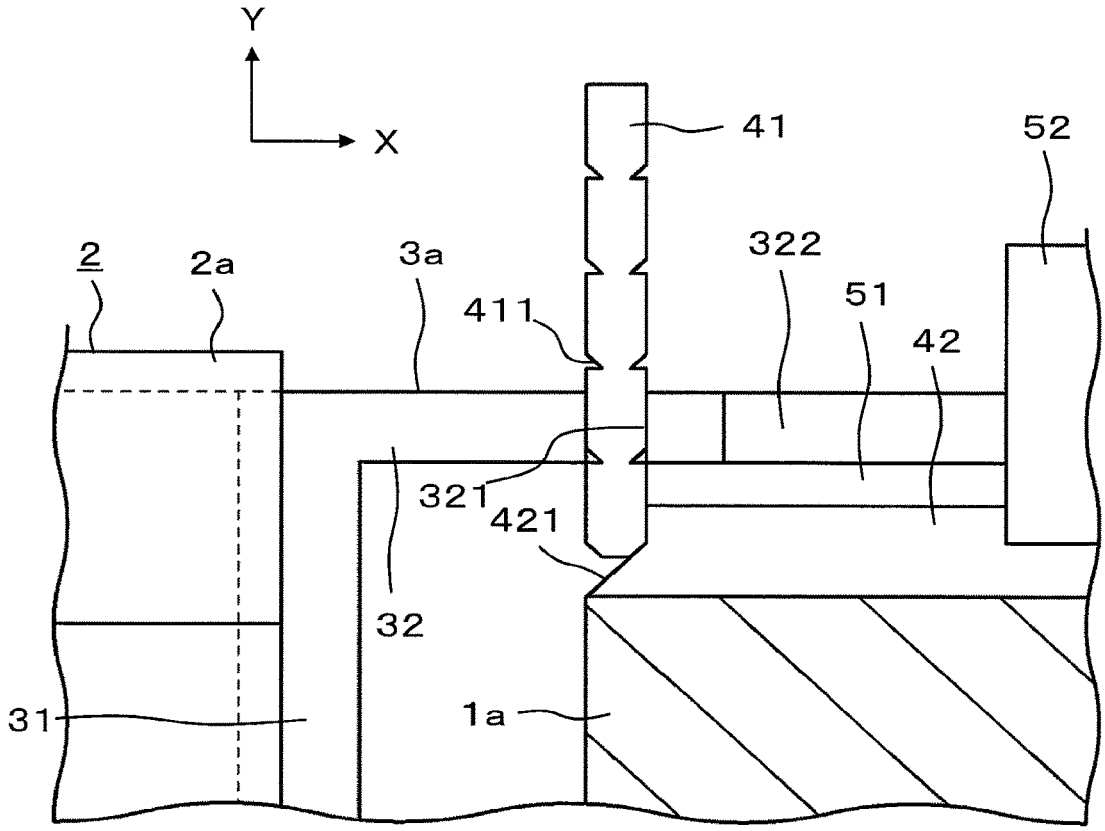
FIG. 4 is an enlarged view for illustrating a support fitting, a semi-fixing pin, and a backup plate illustrated in FIG. 2.

FIG. 4 is an enlarged view for illustrating the support fitting 3*a*, the semi-fixing pin 41, and the backup plate 42 illustrated in FIG. 2. A plurality of cutouts 411 are formed in the semi-fixing pin 41. The plurality of cutouts 411 are arranged in alignment in the height direction. A dimension between the cutouts 411 adjacent to each other in the height direction matches with a dimension between a portion of the backup plate 42, which supports the semi-fixing pin 41, and the lateral plate portion 32 of the support fitting 3*a*. A dimension between the cutout 411 which is arranged lowermost among the plurality of cutouts 411 and the lower end portion of the semi-fixing pin 41 also matches with the dimension between the cutouts 411 which are adjacent to each other in the height direction. Therefore, when the semi-fixing pin 41 is supported on the backup plate 42, the cutouts 411 are arranged so as to match with a lower surface of the lateral plate portion 32 of the support fitting 3*a* in the height direction.

Portions of the semi-fixing pin 41, in which the cutouts 411 are formed, are designed so as to have a strength which does not allow the semi-fixing pin 41 to break even in a case where the frictional force generated when the truss 2 is moved in the longitudinal direction with respect to the lower-side floor 1*b* and the inertia force of the truss 2 generated at the time of occurrence of the earthquake are exerted thereon and allows the semi-fixing pin 41 to break under a load smaller than a buckling load of the truss 2. Therefore, the portions of the semi-fixing pin 41, in which the cutouts 411 are formed, do not break in the case where the frictional force generated when the truss 2 is moved in the longitudinal direction with respect to the lower-side floor 1*b* and the inertia force of the truss 2 generated at the time of occurrence of the earthquake are exerted thereon and break under a force smaller than the buckling load of the truss 2.

In other words, as a specified value, a value which is larger than the frictional force generated when the truss 2 is moved in the longitudinal direction with respect to the upper-side floor 1*a* and the inertia force of the truss 2 generated at the time of occurrence of the earthquake and is smaller than the buckling load of the truss 2 is preset. Therefore, when the approaching force being a force in the direction in which the truss 2 is moved toward the upper-side floor 1*a* is exerted between the truss 2 and the upper-side floor 1*a* and the magnitude of the approaching force is smaller than the specified value, the semi-fixing pin 41 does not break and restrains the movement of the truss 2 in the direction toward the upper-side floor 1*a* to maintain the dimension between the truss 2 and the upper-side floor 1*a* to the preset specified dimension. Meanwhile, when the magnitude of the approaching force is equal to or larger than the specified value, a portion of the semi-fixing pin 41, which is located between the support fitting 3*a* and the backup plate 42, breaks to release the restraint of the movement of the truss 2 in the direction toward the upper-side floor 1*a*.

Figure 5:
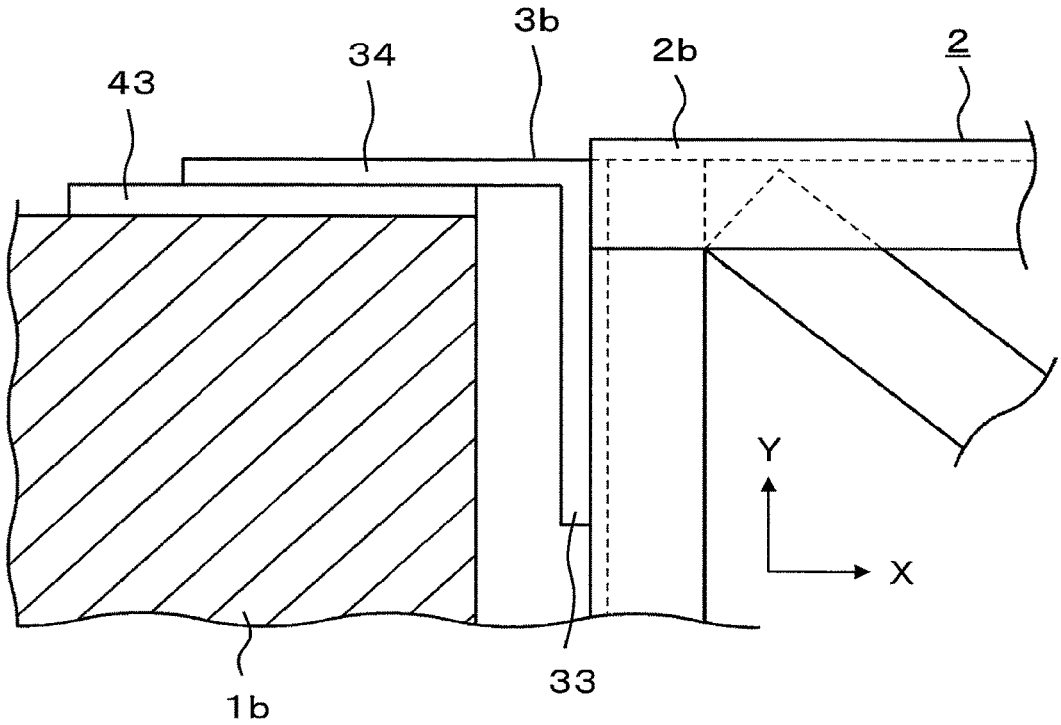
FIG. 5 is an enlarged view for illustrating a lower floor-side part of the escalator illustrated in FIG. 1.

FIG. 5 is an enlarged view for illustrating a lower floor-side part of the escalator illustrated in FIG. 1. A backup plate 43 is fixed onto an upper surface of the lower-side floor 1*b*. Similarly to the support fitting 3*a*, the support fitting 3*b* includes a longitudinal plate portion 33 which is fixed to a longitudinally outwardly oriented surface of the another longitudinal end portion 2*b* and extends in the height direction and a lateral plate portion 34 which extends outward in the longitudinal direction of the truss 2 from an upper portion of the longitudinal plate portion 33. The longitudinal plate portion 33 is arranged so as to be opposed to the lower-side floor 1*b* in the longitudinal direction of the truss 2. The support fitting 3*b* is slidable in the longitudinal direction of the truss 2 with respect to an upper surface of the backup plate 43. A frictional force generated between the lateral plate portion 32 of the support fitting 3*a* and the sliding members 51 is smaller than a frictional force generated between the lateral plate portion 34 of the support fitting 3*b* and the backup plate 43.

Although not illustrated, a pair of width-direction fasteners is fixed onto the backup plate 43. The pair of width-direction fasteners is arranged on an outer side of the support fitting 3*b* in the width direction. The pair of width-direction fasteners restrains the movement of the support fitting 3*b* in the width direction. Specifically, the pair of width-direction fasteners guides the support fitting 3*b* in the longitudinal direction of the truss 2. In this manner, the movement of the another longitudinal end portion 2*b* in the width direction is restrained.

Figure 6:
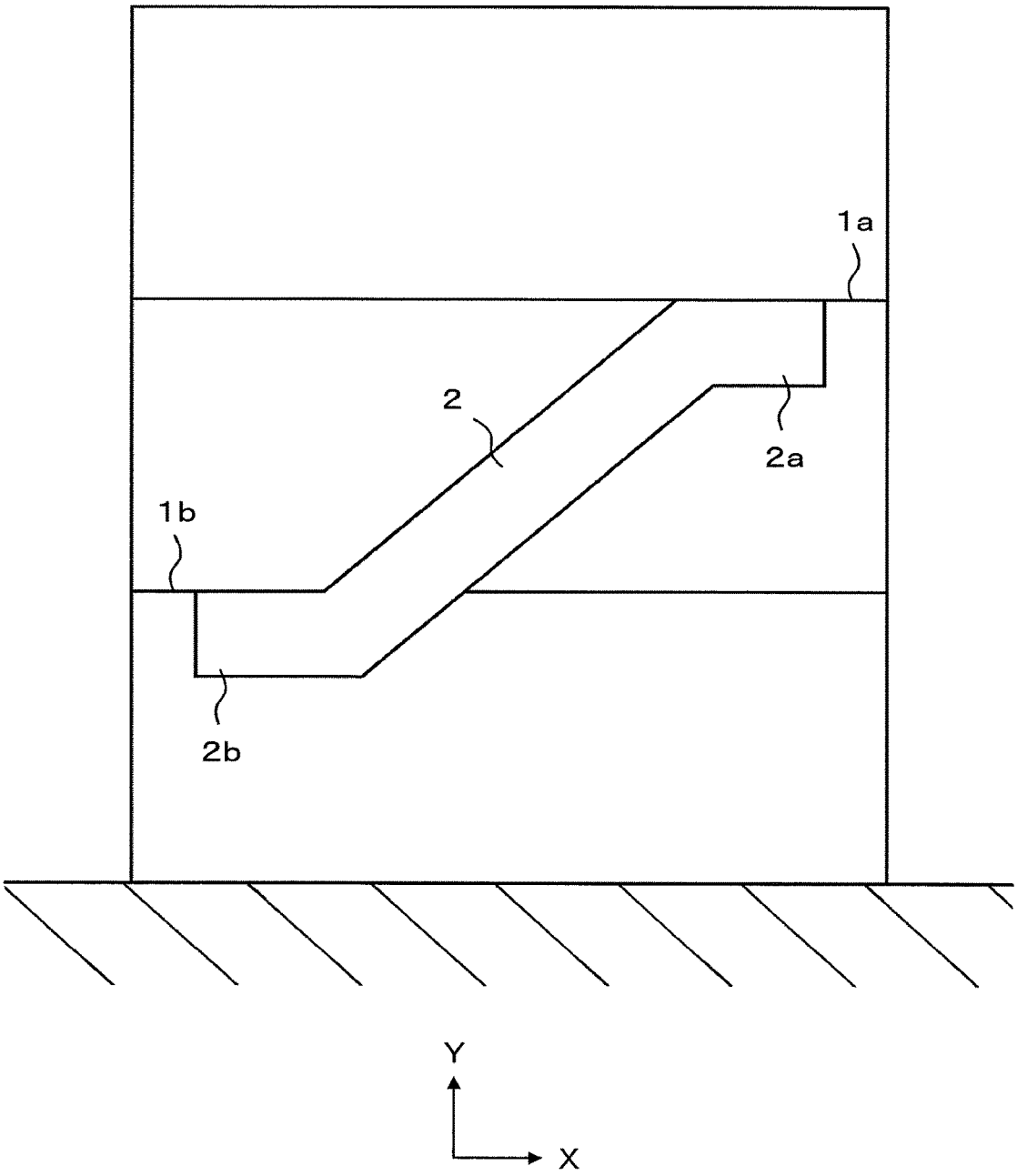
FIG. 6 is a schematic view for illustrating a building in which the escalator illustrated in FIG. 1 is installed.

Next, a behavior of the escalator when an earthquake occurs is described. FIG. 6 is a schematic view for illustrating a building in which the escalator illustrated in FIG. 1 is installed. In the first embodiment, the escalator is installed to bridge a second floor and a third floor in a three-story building. Further, in the first embodiment, as a direction of inclination of the building, a direction of inclination to the right side in FIG. 6 is defined as a positive direction, whereas a direction of inclination to the left side in FIG. 6 is defined as a negative direction.

Figure 7:
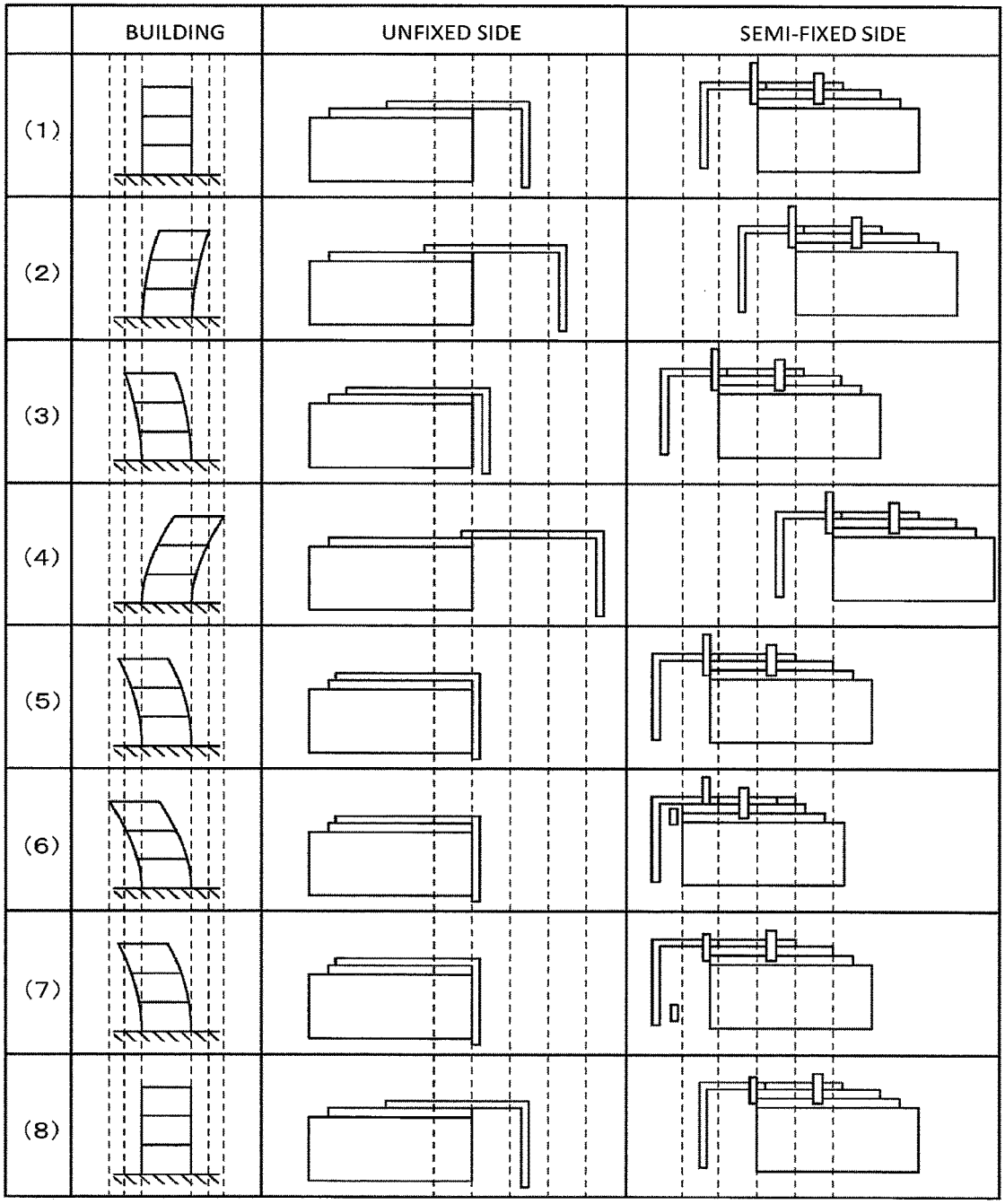
FIG. 7 is a chart for illustrating a relationship between an inclination of the building, a clearance between an upper-side floor and a truss, and a clearance between a lower-side floor and the truss in the building illustrated in FIG. 6 when an earthquake occurs.

FIG. 7 is a chart for illustrating a relationship between the inclination of the building, a clearance between the upper-side floor 1*a* and the truss 2, and a clearance between the lower-side floor 1*b* and the truss 2 in the building illustrated in FIG. 6 when an earthquake occurs. In FIG. 7, the upper floor-side part of the escalator is illustrated as a semi-fixed side, whereas the lower floor-side part of the escalator is illustrated as an unfixed side.

In Part (1) of FIG. 7, a state in which the escalator is installed is illustrated. In this case, the semi-fixed side is installed under a state in which the semi-fixing pin 41 is inserted into the semi-fixing pin hole 321. The dimension between the upper-side floor 1*a* and the longitudinal plate portion 31 of the support fitting 3*a* and the dimension between the lower-side floor 1*b* and the longitudinal plate portion 33 of the support fitting 3*b* are dimensions determined under regulations, respectively. In this case, the dimension between the truss 2 and the upper-side floor 1*a* is the preset specified dimension. The anchor pin 52 is held in contact with the portion of the inner wall of the elongated hole 322, which is the farthest from the truss 2.

In Part (2) of FIG. 7, a state in which a small- or moderate-scale earthquake occurs and the building is inclined in the positive direction is illustrated. The small- or moderate-scale earthquake is an earthquake which causes a displacement at an angle equal to or smaller than a story drift angle calculated according to Article 82-2 of the Order for Enforcement of the Building Standards Act in Japan. The inclination of the building in the positive direction causes movement of the upper floor-side part of the escalator in the positive direction. As a result, a dimension of the escalator between the upper-side floor 1*a* and the lower-side floor 1*b* is increased. In this case, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes larger than that in the case of Part (1). A load corresponding to the frictional force which is generated when the truss 2 is moved in the longitudinal direction with respect to the lower-side floor 1*b* and the inertia force of the truss 2 at the time of occurrence of the earthquake acts on the anchor pin 52.

In Part (3) of FIG. 7, a state in which a small- or moderate-scale earthquake occurs and the building is inclined in the negative direction is illustrated. The inclination of the building in the negative direction causes movement of the upper floor-side part of the escalator in the negative direction. As a result, the dimension of the escalator between the upper-side floor 1*a* and the lower-side floor 1*b* is reduced. In this case, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes smaller than that in the case of Part (1). Although the shake occurs in a compressive direction in which the dimension of the escalator between the upper-side floor 1*a* and the lower-side floor 1*b* is reduced, the clearance still remains between the longitudinal plate portion 33 of the support fitting 3*b* and the lower-side floor 1*b*. Therefore, only the load corresponding to the frictional force generated when the truss 2 is moved in the longitudinal direction with respect to the lower-side floor 1*b* and the inertia force of the truss 2 at the time of occurrence of the earthquake acts on the semi-fixing pin 41.

In Part (4) of FIG. 7, a state in which a large-scale earthquake occurs and the building is inclined in the positive direction is illustrated. The large-scale earthquake is an earthquake which causes a displacement at an angle five times as large as a story drift angle at the time of the moderate-scale earthquake which is calculated according to Article 82-2 of the Order for Enforcement of the Building Standards Act in Japan. The inclination of the building in the positive direction causes the movement of the upper floor-side part of the escalator in the positive direction. In this case, the dimension between the upper-side floor 1*a* and the lower-side floor 1*b* becomes larger than that in the case of Part (2). With this, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes larger than that of the case of Part (2). For the lateral plate portion 34 of the support fitting 3*b*, a large overlap allowance over the lower-side floor 1*b* is provided so that the support fitting 3*b* does not fall off the lower-side floor 1*b* even when the building is inclined in the positive direction due to the occurrence of the large-scale earthquake.

In Part (5) of FIG. 7, a state in which a large-scale earthquake occurs and the building is inclined in the negative direction is illustrated. The inclination of the building in the negative direction causes movement of the upper floor-side part of the escalator in the negative direction. In this case, the dimension between the upper-side floor 1*a* and the lower-side floor 1*b* becomes smaller than that in the case of Part (3). With this, on the unfixed side, the support fitting 3*b* slides with respect to the backup plate 43, and hence the truss 2 is moved in the longitudinal direction with respect to the lower-side floor 1*b*. As a result, the clearance between the lateral plate portion 33 of the support fitting 3*b* and the lower-side floor 1*b* is eliminated. As a result, the truss 2 is compressed in the longitudinal direction, and hence the same magnitude of a load as that of a compression load acting on the truss 2 acts on the semi-fixing pin 41.

In Part (6) of FIG. 7, a state in which the magnitude of the approaching force becomes equal to or larger than the specified value is illustrated. The specified value is a value which is larger than the frictional force generated when the support fitting 3*b* is moved in the longitudinal direction with respect to the lower-side floor 1*b* and the inertia force of the truss 2 generated at the time of occurrence of the earthquake and is smaller than the buckling load of the truss 2. When the building is inclined significantly in the negative direction to such a degree that the magnitude of the approaching force becomes equal to or larger than the specified value, the compression load acting on the truss 22 is increased. Hence, before the load acting on the truss 2 reaches the buckling load, the semi-fixing pin 41 breaks. The breakage of the semi-fixing pin 41 allows the movement of the support fitting 3*a* in the longitudinal direction with respect to the upper-side floor 1*a* so that the clearance between the longitudinal plate portion 31 of the support fitting 3*a* and the upper-side floor 1*a* becomes smaller than that in the case of Part (5). As a result, the dimension between the support fitting 3*a* and the support fitting 3*b* changes in response to the change in dimension between the upper-side floor 1*a* and the lower-side floor 1*b* to eliminate the compression load acting on the truss 2. A fragment of the broken semi-fixing pin 41 falls along the inclined surface 421 of the backup plate 42, and hence the remaining part of the semi-fixing pin 41 is moved together with the support fitting 3*a* in the longitudinal direction with respect to the upper-side floor 1*a*. As a result, the dimension between the truss 2 and the upper-side floor 1*a* becomes smaller than the specified dimension.

In Part (7) of FIG. 7, a state in which the dimension between the truss 2 and the upper-side floor 1*a* is smaller than the specified dimension and the separating force is exerted between the truss 2 and the upper-side floor 1*a* is illustrated. When the building starts shaking in the negative direction under a state in which there is no clearance between the longitudinal plate portion 33 of the support fitting 3*b* and the lower-side floor 1*b* and the dimension between the truss 2 and the upper-side floor 1*a* is smaller than the specified dimension, the dimension between the upper-side floor 1*a* and the lower-side floor 1*b* starts increasing. The frictional force generated between the lateral plate portion 32 of the support fitting 3*a* and the sliding members 51 is smaller than the friction force generated between the lateral plate portion 34 of the support fitting 3*b* and the backup plate 43, and hence the support fitting 3*a* is moved in the longitudinal direction with respect to the upper-side floor 1*a* until the anchor pin 52 is brought into abutment against the portion of the inner wall of the elongated hole 322, which is the farthest from the truss 2, before the support fitting 3*b* is moved in the longitudinal direction with respect to the lower-side floor 1*b*. When the dimension between the truss 2 and the upper-side floor 1*a* becomes equal to the specified dimension, the anchor pin 52 is brought into abutment against the portion of the inner wall of the elongated hole 322, which is the farthest from the truss 2, and hence the semi-fixing pin 41 is moved downward under a self-weight to be supported on the inclined surface 421. The longitudinal plate portion 33 of the support fitting 3*b* and the lower-side floor 1*b* remain in a state of being held in contact with each other until the anchor pin 52 is brought into abutment against the portion of the inner wall of the elongated hole 322, which is the farthest from the truss 2.

In Part (8) of FIG. 7, a state in which the inclination of the building is eliminated after the semi-fixing pin 41 is moved downward under the self-weight to be supported on the inclined surface 421 is illustrated. The building returns to the original installation state. As a result, the dimension between the upper-side floor 1*a* and the lower-side floor 1*b* becomes larger than that in the case of Part (7). In this manner, the anchor pin 52 is brought into abutment against the portion of the inner wall of the elongated hole 322, which is the farthest from the truss 2, and hence the anchor pin 52 pulls the support fitting 3*a* in the longitudinal direction. At this time, on the unfixed side, the lateral plate portion 34 of the support fitting 3*b* is moved in the longitudinal direction with respect to the lower-side floor 1*b*, and hence the dimension between the longitudinal plate portion 33 of the support fitting 3*b* and the lower-side floor 1*b* becomes equal to that in the case of Part (1).

As described above, in the escalator according to the first embodiment of the present invention, when a small- or moderate-scale earthquake occurs, the truss 2 performs the behavior with one fixed end. Therefore, a positional shift between the truss 2 and the upper-side floor 1*a* can be eliminated. Further, in the escalator, when a large-scale earthquake occurs, the truss 2 performs the behavior with both unfixed ends. Therefore, the compression load can be prevented from acting on the truss 2 by changing the dimension between the support fitting 3*a* and the support fitting 3*b* in response to the change in dimension between the upper-side floor 1*a* and the lower-side floor 1*b*. Further, in the escalator, when the building returns to the original state after the occurrence of the large-scale earthquake, the anchor pin 52 is brought into abutment against the portion of the inner wall of the elongated hole 322, which is the farthest from the truss 2, and hence the anchor pin 52 allows the movement of the support fitting 3*a* in the longitudinal direction. Therefore, the dimension between the longitudinal plate portion 33 of the support fitting 3*b* and the lower-side floor 1*b* can be automatically returned to the original state. Further, in the escalator, when the dimension between the truss 2 and the upper-side floor 1*a* is smaller than the specified dimension, the frictional force generated when the truss 2 is moved in the longitudinal direction with respect to the upper-side floor 1*a* is smaller than the frictional force generated when the truss 2 is moved in the longitudinal direction with respect to the lower-side floor 1*b*, and hence, after the truss 2 is first moved in the longitudinal direction with respect to the upper-side floor 1*a* to set the dimension between the truss 2 and the upper-side floor 1*a* to the specified dimension, the truss 2 is moved in the longitudinal direction with respect to the lower-side floor 1*b* so that the dimension between the truss 2 and the lower-side floor 1*b* can be set to the original dimension.

Further, in the escalator, when a large-scale earthquake occurs and the approaching force exerted between the truss 2 and the upper-side floor 1*a* is equal to or larger than the specified value, the semi-fixing pin 41 breaks and part of the broken semi-fixing pin 41 falls. Then, when the dimension between the truss 2 and the upper-side floor 1*a* becomes equal to the specified dimension, the semi-fixing pin 41 is supported on the inclined surface 421 under the self-weight. Therefore, the movement of the truss 2 in the direction toward the upper-side floor 1*a* can be restrained again. Further, after the occurrence of the large-scale earthquake, an engineer is not required to pull out the broken semi-fixing pin 41 and mount the new semi-fixing pin 41. Therefore, an effect can be obtained for the occurrence of the large-scale earthquake for a plurality of times.

Further, the support fitting 3*a* can be manufactured only by forming the semi-fixing pin hole 321 and the elongated hole 322 in a related-art support fitting. Therefore, the support fitting 3*a* can be easily manufactured.

Figure 8A:
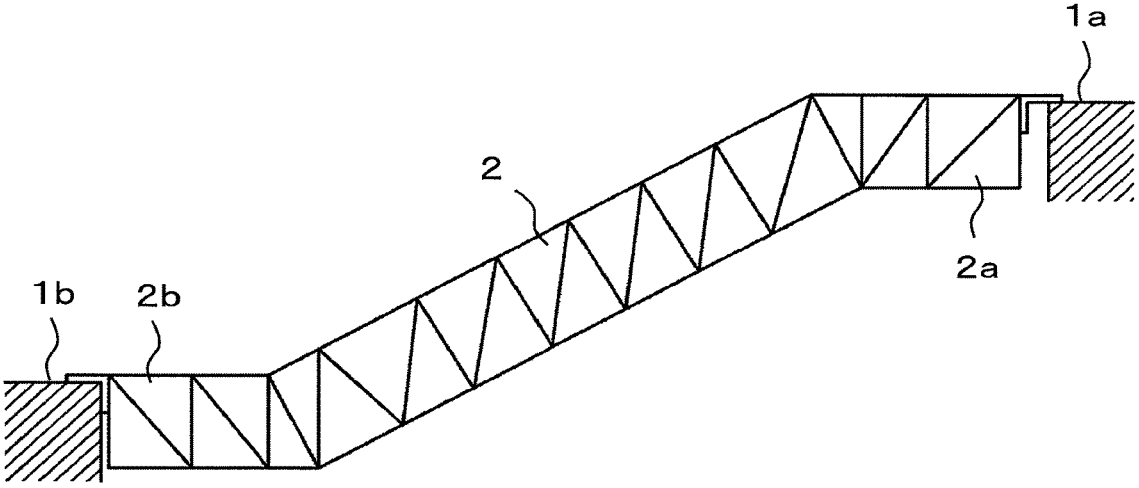
FIG. 8 are views each for illustrating a state of a related-art escalator after occurrence of a large-scale earthquake.
Figure 8B:
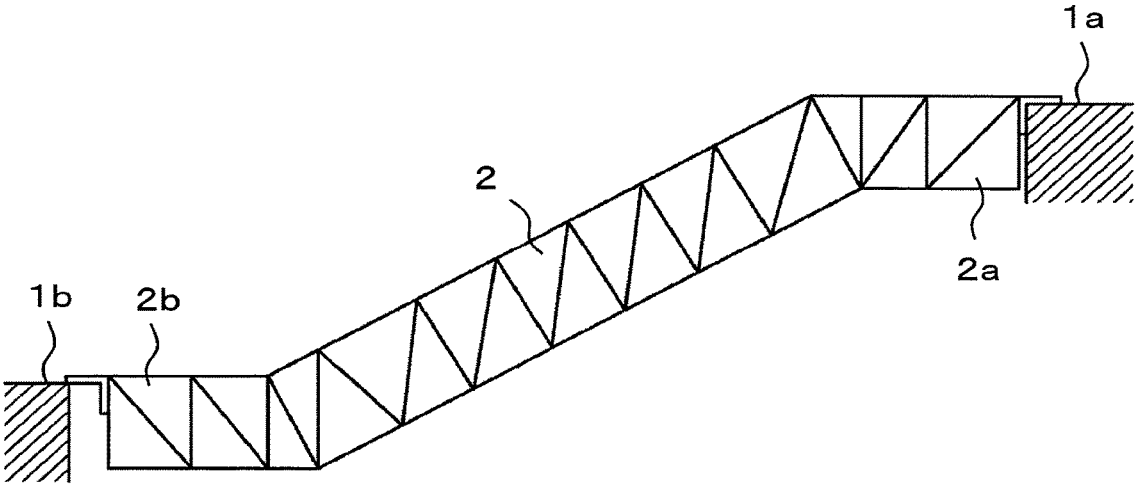

FIG. 8 are views each for illustrating a state of a related-art escalator after the occurrence of the large-scale earthquake. In a case of the related-art escalator, when the large-scale earthquake strikes the escalator, a position of the truss 2 is shifted from a position of installation. For example, the position of the truss 2 is shifted toward the lower-side floor 1*b* as illustrated in FIG. 8(*a*) or the position of the truss 2 is shifted toward the upper-side floor 1*a* as illustrated in FIG. 8(*b*) in some cases. In those cases, even when the truss 2 is not buckled without being subjected to the compression load, work for lifting up the truss 2 by means of a crane or other machines to return the truss 2 back to an original position is required for recovery. In the present invention, the position of the truss 2 automatically returns to the position of installation being the original position by using the shake of the building after the occurrence of an earthquake. Therefore, the work for returning the truss 2 back to the original position is not required.

Although one floor is defined as the upper-side floor 1*a*, another floor is defined as the lower-side floor 1*b*, one support fitting is defined as the support fitting 3*a*, and another support fitting is defined as the support fitting 3*b* in the first embodiment, the one floor may be defined as the lower-side floor 1*b*, the another floor may be defined as the upper-side floor 1*a*, the one support fitting may be defined as the support fitting 3*b*, and the another support fitting may be defined as the support fitting 3*a*. Specifically, the lower floor-side part of the escalator may be the semi-fixed side, whereas the upper floor-side part of the escalator may be the unfixed side.

Further, although the sliding members 51 are provided between the support fitting 3*a* and the backup plate 42 in the first embodiment described above, a friction member may be provided between the support fitting 3*b* and the backup plate 43 without providing the siding members 51 between the support fitting 3*a* and the backup plate 42. In this case, for the friction member, when the dimension between the truss 2 and the upper-side floor 1*a* is smaller than the specified dimension after the restraint of movement of the truss 2 in the direction toward the upper-side floor 1*a* is released and the separating force is exerted between the truss 2 and the upper-side floor 1*a*, the frictional force which is generated when the support fitting 3*b* is moved in the longitudinal direction with respect to the lower-side floor 1*b* is set larger than the frictional force which is generated when the support fitting 3*a* is moved in the longitudinal direction with respect to the upper-side floor 1*a*.

Further, although each of the shape of the semi-fixing pin 41 and the shape of the anchor pin 52 is the columnar shape in the first embodiment described above, each of the shape of the semi-fixing pin 41 and the shape of the anchor pin 52 is not limited to the columnar shape and may be other shapes.

Although the semi-fixing pin 41 breaks under the load which is larger than the frictional force generated when the support fitting 3*b* is moved in the longitudinal direction with respect to the lower-side floor 1*b* and the inertia force of the truss 2 generated at the time of occurrence of the earthquake and is smaller than the buckling load of the truss 2 by forming the cutouts 411 in the semi-fixing pin 41 in the first embodiment described above, the semi-fixing pin 41 without the cutouts 411 may be used as long as the semi-fixing pin 41 itself satisfies the above-mentioned conditions.

Second Embodiment

Figure 9:
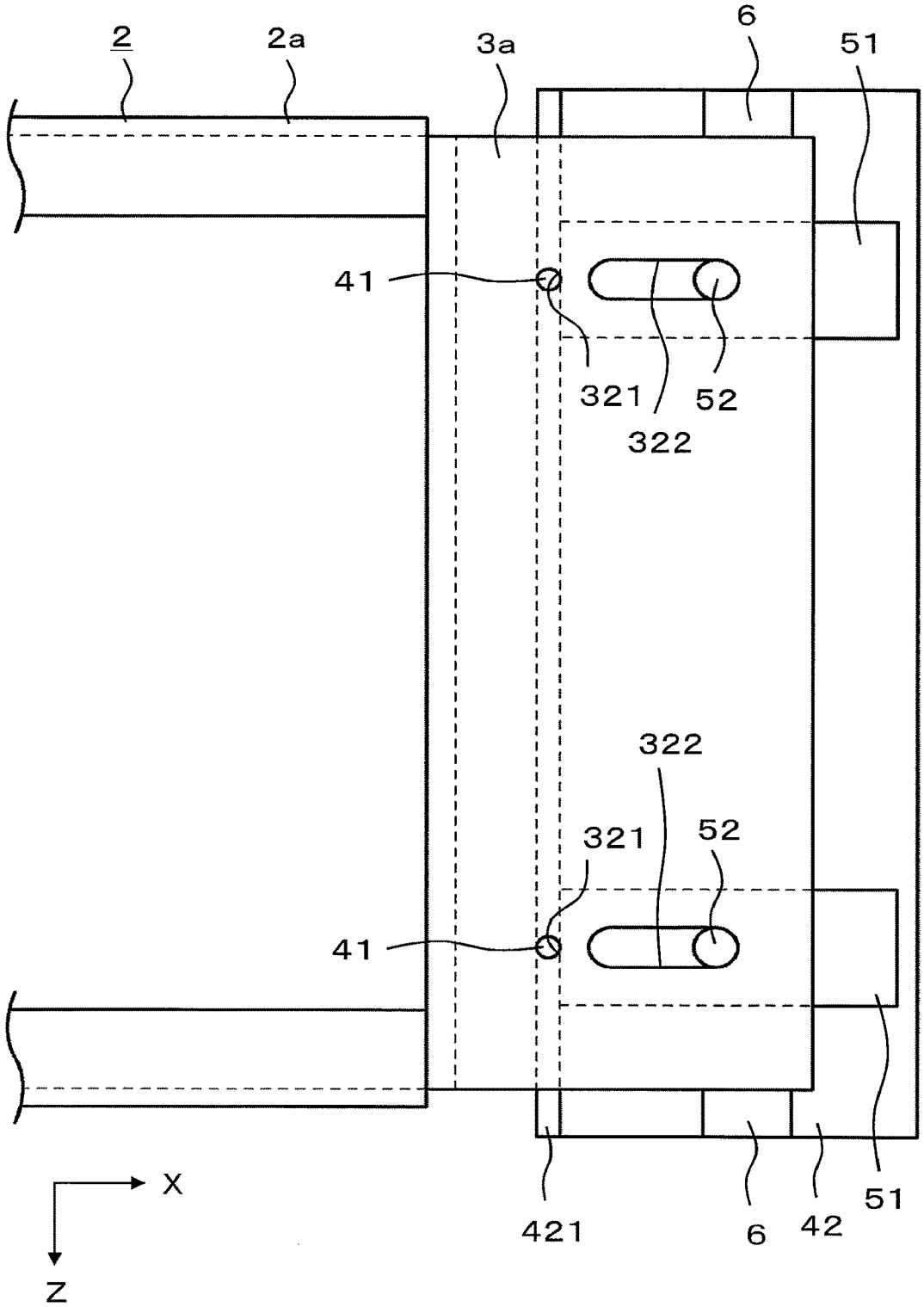
FIG. 9 is a plan view for illustrating an upper floor-side part of an escalator according to a second embodiment of the present invention.

FIG. 9 is a plan view for illustrating an upper floor-side part of an escalator according to a second embodiment of the present invention. The number of semi-fixing pins 41 and the number of anchor pins 52 are each two. The pair of semi-fixing pins 41 is arranged so as to be separated from each other in the width direction. The pair of anchor pins 52 is arranged so as to be separated from each other in the width direction. Two of each of the semi-fixing pin holes 321 and the elongated holes 322 are formed in the support fitting 3*a* so as to correspond to the semi-fixing pins 41 and the anchor pins 52.

Although the semi-fixing pin 41 is designed to break under the load smaller than the buckling load of the truss 2 by forming the cutouts 411 in the semi-fixing pin 41 in the first embodiment, the semi-fixing pins 41 are designed to have such a strength that the sum of strengths of the two semi-fixing pins 41 allows the two semi-fixing pins 41 to break under the load smaller than the buckling load of the truss 2 in the second embodiment.

Further, although the anchor pin 52 is designed to have the strength which does not allow the anchor pin 52 to break even in the case where the frictional force generated when the truss 2 is moved in the longitudinal direction with respect to the lower-side floor 1*b* and the inertia force of the truss 2 generated at the time of occurrence of the earthquake act on the anchor pin 52 in the first embodiment, the anchor pins 52 are designed to have such strengths that the sum of strengths of the two anchor pins 52 does not allow the anchor pins 52 to break even in the case where the frictional force generated when the truss 2 is moved in the longitudinal direction with respect to the lower-side floor 1*b* and the inertia force of the truss 2 generated at the time of occurrence of the earthquake act on the two anchor pins 52 in the second embodiment. Therefore, a thickness of each of the anchor pins 52 in the second embodiment is smaller than a thickness of the anchor pin 52 in the first embodiment. The remaining configuration is the same as that in the first embodiment.

The buckling load of the truss 2 at the time of occurrence of the earthquake, the frictional force which is generated when the truss 2 is moved in the longitudinal direction with respect to the lower-side floor 1*b*, and the inertia force of the truss 2 generated at the time of occurrence of the earthquake differ depending on specifications including a story height of the truss 2 and a weight of the truss 2. Therefore, the strength required for each of the semi-fixing pins 41 and the strength required for each of the anchor pins 52 differ depending on a construction in which the escalator is installed. Therefore, the semi-fixing pins 41 and the anchor pins 52 which have various thicknesses are required. In the second embodiment, two of each of the semi-fixing pins 41 and the anchor pins 52 are provided. Therefore, the strength required for each of the semi-fixing pins 41 and the strength required for each of the anchor pins 52 can be adjusted without changing the thickness of each of the semi-fixing pins 41 and the thickness of each of the anchor pins 52.

As described above, in the escalator according to the second embodiment of the present invention, two of each of the semi-fixing pins 41 and the anchor pins 52 are provided. Therefore, the strength required for each of the semi-fixing pins 41 and the strength required for each of the anchor pins 52 can be adjusted without changing the thickness of each of the semi-fixing pins 41 and the thickness of each of the anchor pins 52.

Figure 10:
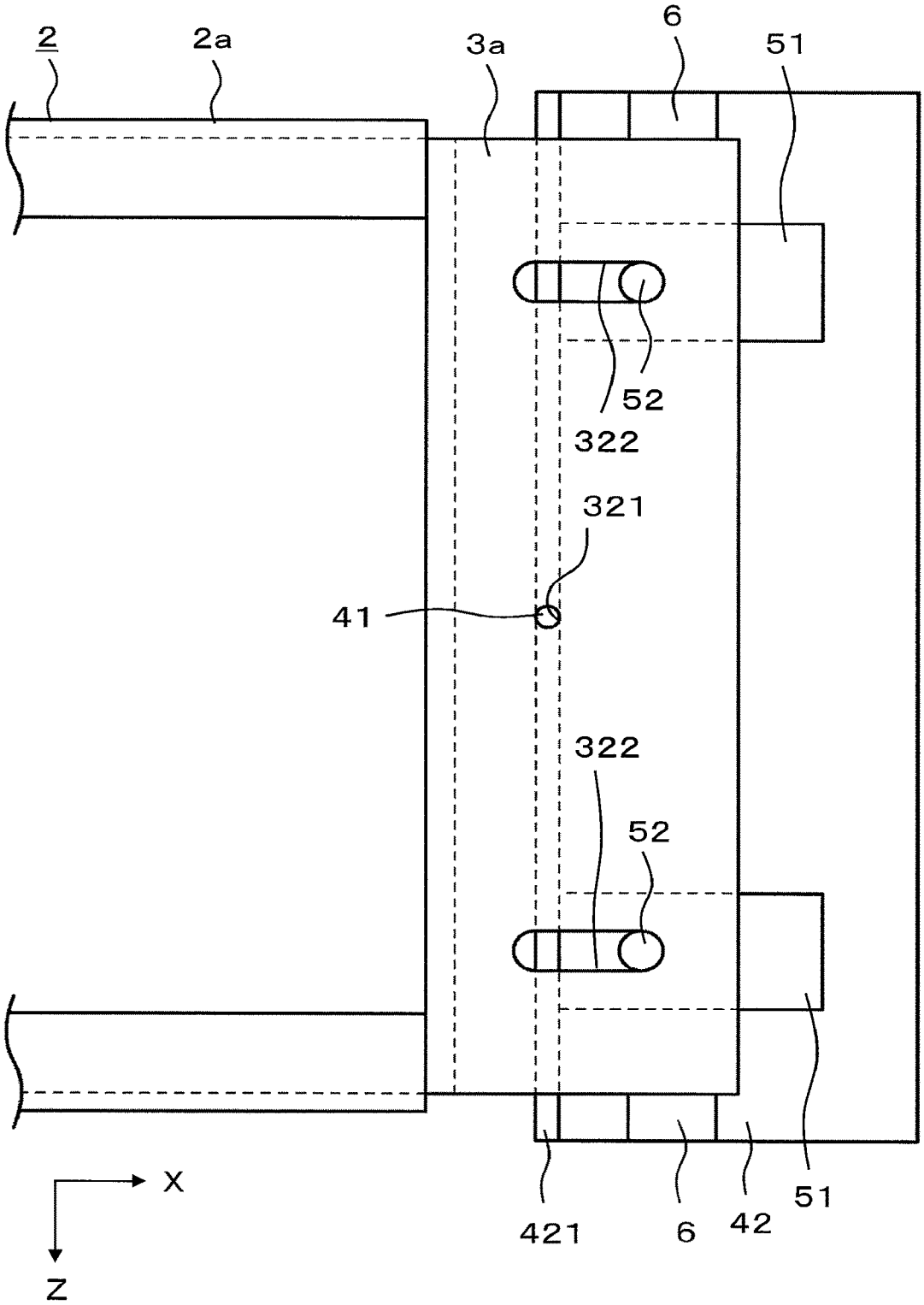
FIG. 10 is a plan view for illustrating a modification example of the upper floor-side part of the escalator illustrated in FIG. 9.

Although two of each of the semi-fixing pins 41 and the anchor pins 52 are provided in the second embodiment described above, any number of semi-fixing pins 41 and any number of anchor pins 52 may be provided. Further, the number of semi-fixing pins 41 and the number of anchor pins 52 are not required to be equal to each other. FIG. 10 is a plan view for illustrating a modification example of the upper floor-side part of the escalator illustrated in FIG. 9. In FIG. 10, one semi-fixing pin 41 is provided, whereas two anchor pins 52 are provided. Also in this case, the same effects as those obtained by the configuration of the second embodiment can be obtained. The numbers and the arrangements of semi-fixing pins 41, anchor pins 52, and sliding members 51 may be used in various combinations.

Further, although the semi-fixing pin hole 321 and the elongated hole 322 are arranged so as to be adjacent to each other in the longitudinal direction in the second embodiment, the semi-fixing pin hole 321 and the elongated holes 322 may be arranged so as to be separated from each other in the width direction, as illustrated in FIG. 10. In this case, the semi-fixing pin hole 321 and the elongated holes 322 are arranged so as to overlap each other when viewed in the width direction. In this manner, as compared to the case where the semi-fixing pin holes 321 and the elongated holes 322 are arranged so as to be adjacent to each other in the longitudinal direction, an interval is not required to be provided in the longitudinal direction between the semi-fixing pin hole 321 and the elongated holes 322. Therefore, a dimension of the support fitting 3*a* in the longitudinal direction can be reduced.

Third Embodiment

Figure 11:
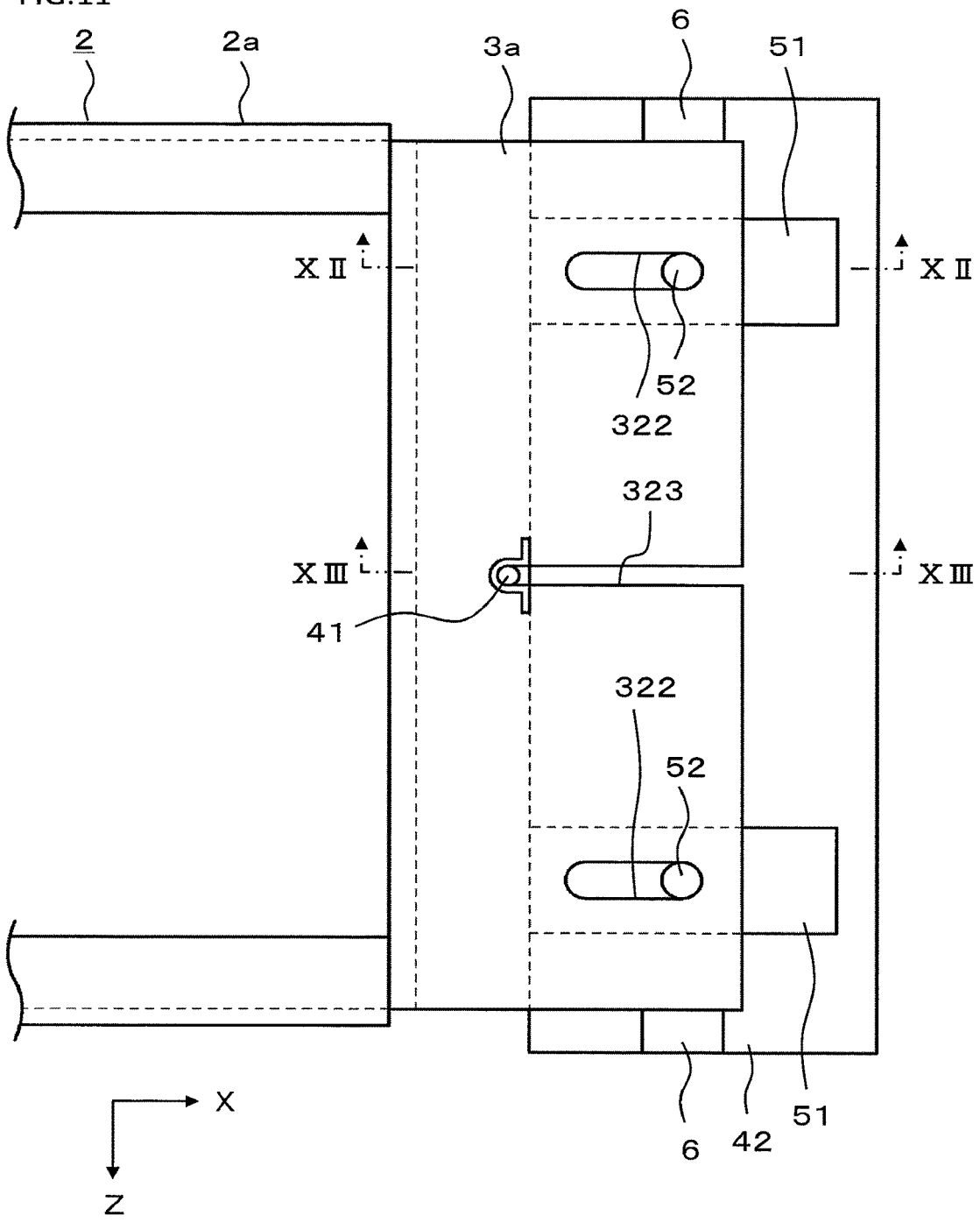
FIG. 11 is a plan view for illustrating an upper floor-side part of an escalator according to a third embodiment of the present invention.
Figure 12:
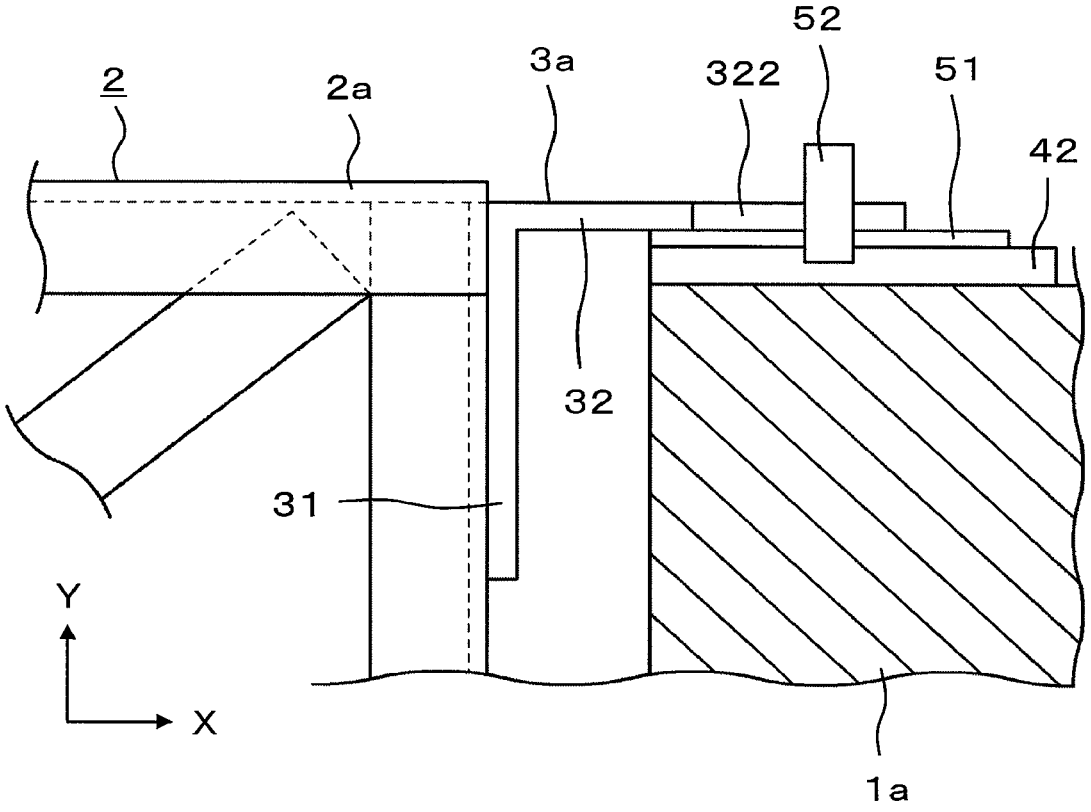
FIG. 12 is a sectional view on arrow taken along the line XII-XII of FIG. 11.
Figure 13:
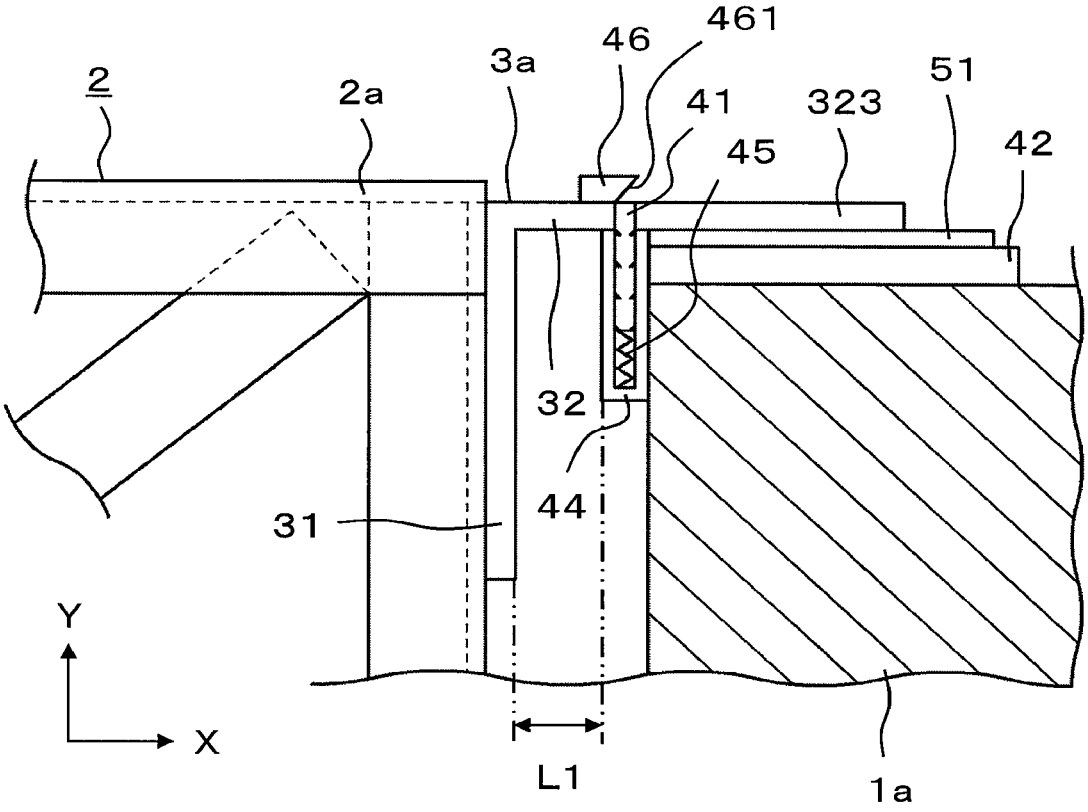
FIG. 13 is a sectional view on arrow taken along the line XIII-XIII of FIG. 11.

FIG. 11 is a plan view for illustrating an upper floor-side part of an escalator according to a third embodiment of the present invention, FIG. 12 is a sectional view on arrow taken along the line XII-XII of FIG. 11, and FIG. 13 is a sectional view on arrow taken along the line XIII-XIII of FIG. 11. A semi-fixing pin hole 323 is formed in the lateral plate portion 32 of the support fitting 3*a* to extend from a longitudinally outer end surface of the lateral plate portion 32 toward the longitudinal plate portion 31. The semi-fixing pin hole 323 is formed to pass through the lateral plate portion 32 in the height direction. A longitudinally outer end portion of the semi-fixing pin hole 323 reaches the longitudinally outer end surface of the lateral plate portion 32. Specifically, the semi-fixing pin hole 323 is a groove which is formed to extend from the longitudinally outer end surface of the lateral plate portion 32 toward the longitudinal plate portion 31. Further, the pair of elongated holes 322 is formed in the lateral plate portion 32 of the support fitting 3*a*.

The semi-fixing mechanism includes the semi-fixing pin 41 which is inserted into the semi-fixing pin hole 323, a cylinder 44 which is fixed to the upper-side floor 1*a* at a position lower than the semi-fixing pin hole 323, into which the lower end portion of the semi-fixing pin 41 is inserted, a spring 45 which is provided to an inner bottom of the cylinder 44 and presses the semi-fixing pin 41 upward, and a holding plate 46 which is fixed to the support fitting 3*a* and restricts upward movement of the semi-fixing pin 41.

The cylinder 44 is provided in the clearance between the longitudinal plate portion 31 of the support fitting 3*a* and the upper-side floor 1*a*.

The spring 45 is arranged between the bottom of the cylinder 44 and the semi-fixing pin 41.

The holding plate 46 has an inclined surface 461 which is inclined with respect to the horizontal plane. The inclined surface 461 is inclined with respect to the horizontal plane so as to be gradually separated from the truss 2 in an upward direction.

A portion of an inner wall of the semi-fixing pin hole 323, which is the closest to the truss 2, is located above the cylinder 44 when the dimension between the truss 2 and the upper-side floor 1*a* is the specified dimension. An upper end portion of the semi-fixing pin 41 is brought into abutment against the inclined surface 461 to be pressed downward by the holding plate 46. The lower end portion of the semi-fixing pin 41 is pushed upward by the spring 45.

The truss-position recovery mechanism includes the pair of anchor pins 52. The anchor pins 52 are inserted into the elongated holes 322, respectively. A lower end portion of each of the anchor pins 52 is driven into the backup plate 42. The semi-fixing pin 41 and the anchor pins 52 are arranged so as to be separated from each other in the width direction.

A longitudinal dimension L1 between the longitudinal plate portion 31 of the support fitting 3*a* and the cylinder 44 is the same as the longitudinal dimension L1 between the longitudinal plate portion 31 of the support fitting 3*a* and the upper-side floor 1*a* in the first embodiment. The remaining configuration is the same as those of the first embodiment and the second embodiment.

Figure 14:
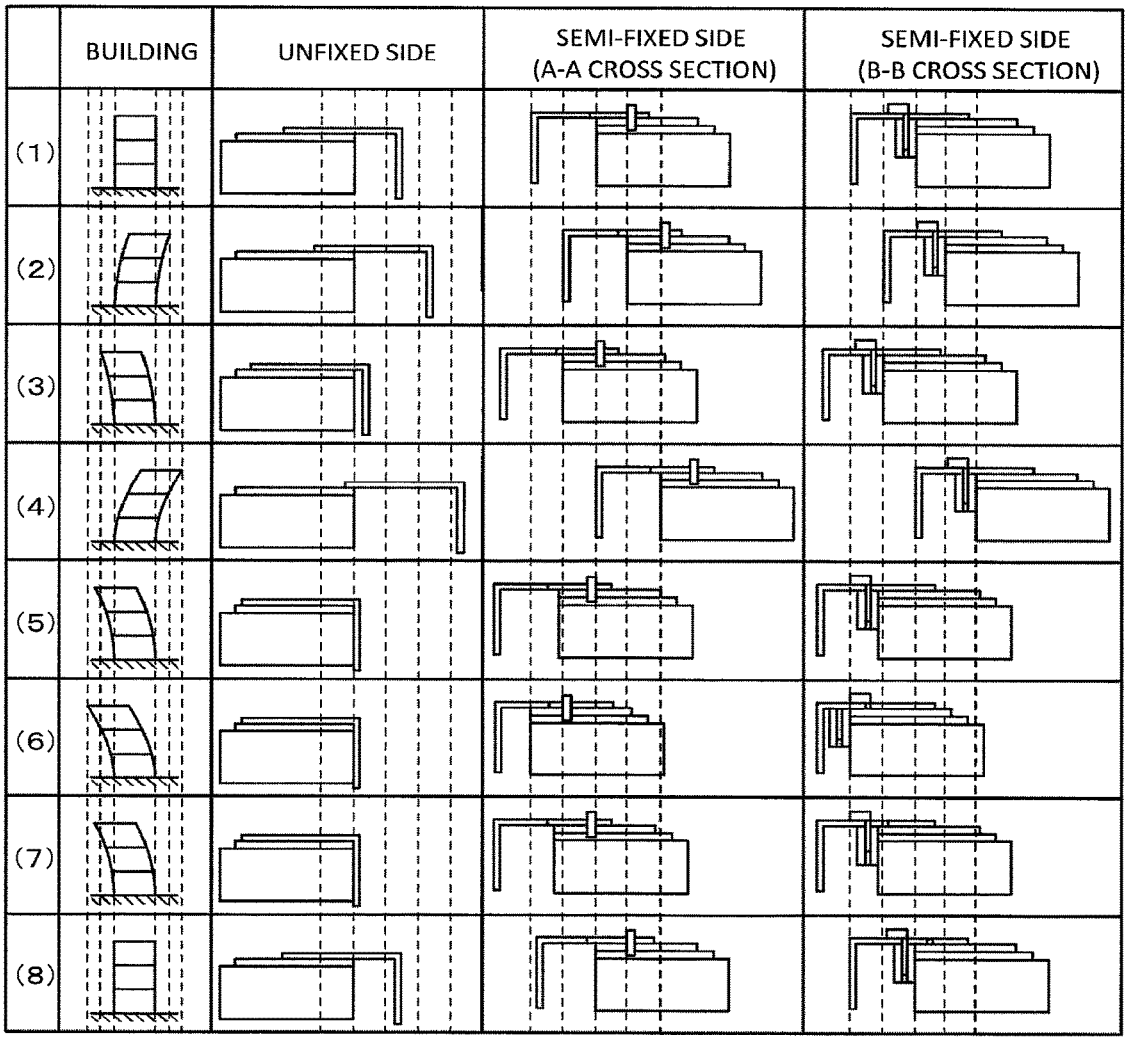
FIG. 14 is a chart for illustrating a relationship between an inclination of the building, a clearance between an upper-side floor and a truss, and a clearance between a lower-side floor and the truss in the building illustrated in FIG. 6 when an earthquake occurs.

Next, a behavior of the escalator when an earthquake occurs is described. FIG. 14 is a chart for illustrating a relationship between the inclination of the building, a clearance between the upper-side floor 1*a* and the truss 2, and a clearance between the lower-side floor 1*b* and the truss 2 in the building illustrated in FIG. 6 when an earthquake occurs. Similarly to the first embodiment, as a direction of inclination of the building, a direction of inclination to the right side in FIG. 14 is defined as a positive direction, whereas a direction of inclination to the left side in FIG. 14 is defined as a negative direction. In FIG. 14, the upper floor-side part of the escalator is illustrated as a semi-fixed side, whereas the lower floor-side part of the escalator is illustrated as an unfixed side.

In Part (1) of FIG. 14, a state in which the escalator is installed is illustrated. In this case, the semi-fixed side is installed under a state in which the semi-fixing pin 41 is inserted into an end portion of the semi-fixing pin hole 323 on the truss 2 side. Each of the anchor pins 52 is arranged in a state of being inserted into a portion of the elongated hole 322, which is the farthest from the truss 2. The dimension between the cylinder 44 and the longitudinal plate portion 31 of the support fitting 3*a* and the dimension between the lower-side floor 1*b* and the longitudinal plate portion 33 of the support fitting 3*b* are dimensions determined under regulations, respectively. In this case, the dimension between the truss 2 and the upper-side floor 1*a* is the specified dimension. The anchor pins 52 are held in contact with the portions of the inner walls of the elongated holes 322, which are the farthest from the truss 2, respectively.

In Part (2) of FIG. 14, a state in which a small- or moderate-scale earthquake occurs and the building is inclined in the negative direction is illustrated. The inclination of the building in the negative direction causes movement of the upper floor-side part of the escalator in the negative direction. As a result, a dimension of the escalator between the upper floor-side part and the lower floor-side part is increased. In this case, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes larger than that in the case of Part (1). A load corresponding to the frictional force which is generated when the truss 2 is moved in the longitudinal direction with respect to the lower-side floor 1*b* and the inertia force of the truss 2 at the time of occurrence of the earthquake acts on the anchor pin 52.

In Part (3) of FIG. 14, a state in which a small- or moderate-scale earthquake occurs and the building is inclined in the negative direction is illustrated. The inclination of the building in the negative direction causes movement of the upper floor-side part of the escalator in the negative direction. As a result, a dimension of the escalator between the upper floor-side part and the lower floor-side part is reduced. In this case, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes smaller than that in the case of Part (1). Although the shake occurs in a compressive direction in which the dimension of the escalator between the upper floor-side part and the lower floor-side part is reduced, the clearance still remains between the longitudinal plate portion 33 of the support fitting 3*b* and the lower-side floor 1*b*. Therefore, only the load corresponding to the frictional force generated when the truss 2 is moved in the longitudinal direction with respect to the lower-side floor 1*b* and the inertia force of the truss 2 at the time of occurrence of the earthquake acts on the semi-fixing pin 41.

In Part (4) of FIG. 14, a state in which a large-scale earthquake occurs and the building is inclined in the positive direction is illustrated. The inclination of the building in the positive direction causes movement of the upper floor-side part of the escalator in the positive direction. In this case, the dimension between the upper-side floor 1*a* and the lower-side floor 1*b* becomes larger than that in the case of Part (2). As a result, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* becomes larger than that of the case of Part (2). For the lateral plate portion 34 of the support fitting 3*b*, a large overlap allowance over the lower-side floor 1*b* is provided so that the support fitting 3*b* does not fall off the lower-side floor 1*b* even when the building is inclined in the positive direction due to the occurrence of the large-scale earthquake.

In Part (5) of FIG. 14, a state in which a large-scale earthquake occurs and the building is inclined in the negative direction is illustrated. The inclination of the building in the negative direction causes movement of the upper floor-side part of the escalator in the negative direction. In this case, the dimension between the upper-side floor 1*a* and the lower-side floor 1*b* becomes smaller than that in the case of Part (3). As a result, on the unfixed side, the support fitting 3*b* slides with respect to the backup plate 43, and hence the truss 2 is moved in the longitudinal direction with respect to the lower-side floor 1*b*. As a result, the clearance between the longitudinal plate portion 33 of the support fitting 3*b* and the lower-side floor 1*b* is eliminated. As a result, the truss 2 is compressed, and hence the same magnitude of a load as that of a compression load acting on the truss 2 acts on the semi-fixing pin 41.

In Part (6) of FIG. 14, a state in which the magnitude of the approaching force becomes equal to or larger than the specified value is illustrated. The specified value is set to a value which is larger than the frictional force generated when the support fitting 3*b* is moved in the longitudinal direction with respect to the lower-side floor 1*b* and the inertia force of the truss 2 generated at the time of occurrence of the earthquake and is smaller than the buckling load of the truss 2. When the building is inclined significantly in the negative direction to such a degree that the magnitude of the approaching force becomes equal to or larger than the specified value, the compression load acting on the truss 22 is increased. Hence, before the load acting on the truss 2 reaches the buckling load, the semi-fixing pin 41 breaks. The breakage of the semi-fixing pin 41 allows the movement of the support fitting 3*a* in the longitudinal direction with respect to the upper-side floor 1*a* so that the clearance between the longitudinal plate portion 31 of the support fitting 3*a* and the upper-side floor 1*a* becomes smaller than that in the case of Part (5). As a result, the dimension between the support fitting 3*a* and the support fitting 3*b* changes in response to the change in dimension between the upper-side floor 1*a* and the lower-side floor 1*b* to eliminate the compression load acting on the truss. A fragment of the broken semi-fixing pin 41 is moved together with the support fitting 3*a* in the longitudinal direction toward the upper-side floor 1*a*. The remaining part of the semi-fixing pin 41 which is provided inside the cylinder 44 is placed in a state of being held from above by the lateral plate portion 32 of the support fitting 3*a*. As a result, the dimension between the truss 2 and the upper-side floor 1*a* becomes smaller than the specified dimension.

In Part (7) of FIG. 14, a state in which the dimension between the truss 2 and the upper-side floor 1*a* is smaller than the specified dimension and the separating force is exerted between the truss 2 and the upper-side floor 1*a* is illustrated. When the building starts shaking in the opposite direction under a state in which there is no clearance between the longitudinal plate portion 33 of the support fitting 3*b* and the lower-side floor 1*b* and the dimension between the truss 2 and the upper-side floor 1*a* is smaller than the specified dimension, the dimension between the upper-side floor 1*a* and the lower-side floor 1*b* starts increasing. As a result, the frictional force generated between the lateral plate portion 32 of the support fitting 3*a* and the sliding members 51 is smaller than the friction force generated between the lateral plate portion 34 of the support fitting 3*b* and the backup plate 43, and hence the support fitting 3*a* is moved in the longitudinal direction with respect to the upper-side floor 1*a* until the anchor pins 52 are brought into abutment against the portions of the inner walls of the elongated holes 322, which are the farthest from the truss 2, respectively. When the dimension between the truss 2 and the upper-side floor 1*a* becomes equal to the specified dimension, the anchor pins 52 are brought into abutment against the portions of the inner walls of the elongated holes 322, which are the farthest from the truss 2, respectively, and hence the semi-fixing pin hole 323 is located above the semi-fixing pin 41. Then, the semi-fixing pin 41 is lifted up by a force of the spring 45 to be brought into abutment against the inclined surface 461. The broken portion of the semi-fixing pin 41 still remains on the backup plate 42. The semi-fixing pin hole 323 is formed to extend to the end surface of the lateral plate portion 32 of the support fitting 3*a* on the upper-side floor 1*a* side. Therefore, even when the semi-fixing pin 41 repeatedly breaks due to the occurrence of a large-scale earthquake, the broken portions of the semi-fixing pin 41 are successively pushed out to the upper-side floor 1*a* side.

In Part (8) of FIG. 14, a state in which the inclination of the building is eliminated after the semi-fixing pin 41 is moved upward by a force of the spring 45 to be brought into abutment against the inclined surface 461 is illustrated. The building returns to the original installation state. As a result, the dimension between the upper-side floor 1*a* and the lower-side floor 1*b* becomes larger than that in the case of Part (7). In this manner, the anchor pins 52 are brought into abutment against the portions of the inner walls of the elongated holes 322, which are the farthest from the truss 2, and hence the anchor pins 52 pull the support fitting 3*a* in the longitudinal direction. At this time, on the unfixed side, the lateral plate portion 34 of the support fitting 3*b* is moved in the longitudinal direction with respect to the lower-side floor 1*b*, and hence the dimension between the longitudinal plate portion 33 of the support fitting 3*b* and the lower-side floor 1*b* becomes equal to that in the case of Part (1).

As described above, in the escalator according to the third embodiment of the present invention, the semi-fixing pin 41 is arranged between the truss 2 and the upper-side floor 1*a* so as to achieve a structure in which the semi-fixing pin 41 is pushed up from below. In this manner, the semi-fixing pin 41 can be prevented from projecting upward beyond the support fitting 3*a*. With the structure of the first embodiment, for coping with the occurrence of earthquake for a plurality of times, a dimension of the semi-fixing pin 41 in a length direction is increased. Thus, a space for the semi-fixing pin 41 is required above the support fitting 3*a*. Although not illustrated, however, a floor plate provided to allow a passenger to walk thereon or other members are installed on an upper side of the truss 2. Therefore, it is difficult to ensure the space for the semi-fixing pin 41. With the structure of the third embodiment, the semi-fixing pin 41 is arranged in the clearance between the truss 2 and the upper-side floor 1*a*. Therefore, a space which is originally unused is used, and hence the dimension of the semi-fixing pin 41 in the length direction can be easily increased. The other effects are the same as those obtained in the first embodiment.

Fourth Embodiment

Figure 15:
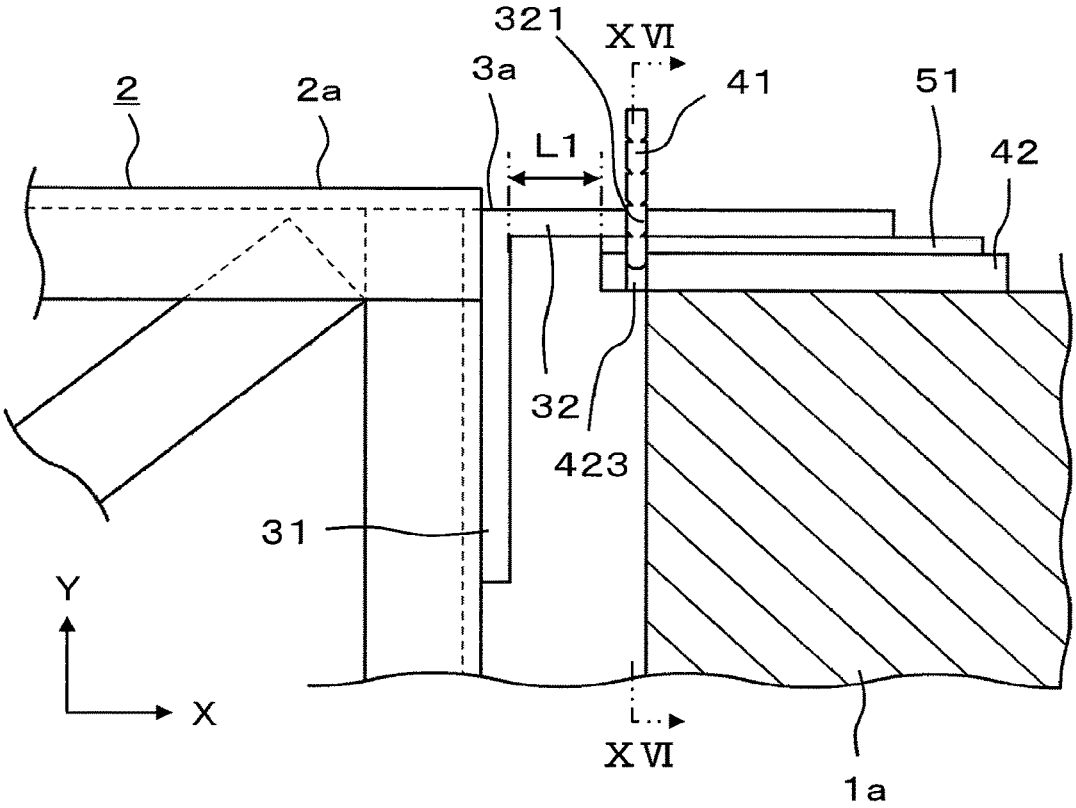
FIG. 15 is a side view for illustrating an upper floor-side part of an escalator according to a fourth embodiment of the present invention.
Figure 16:
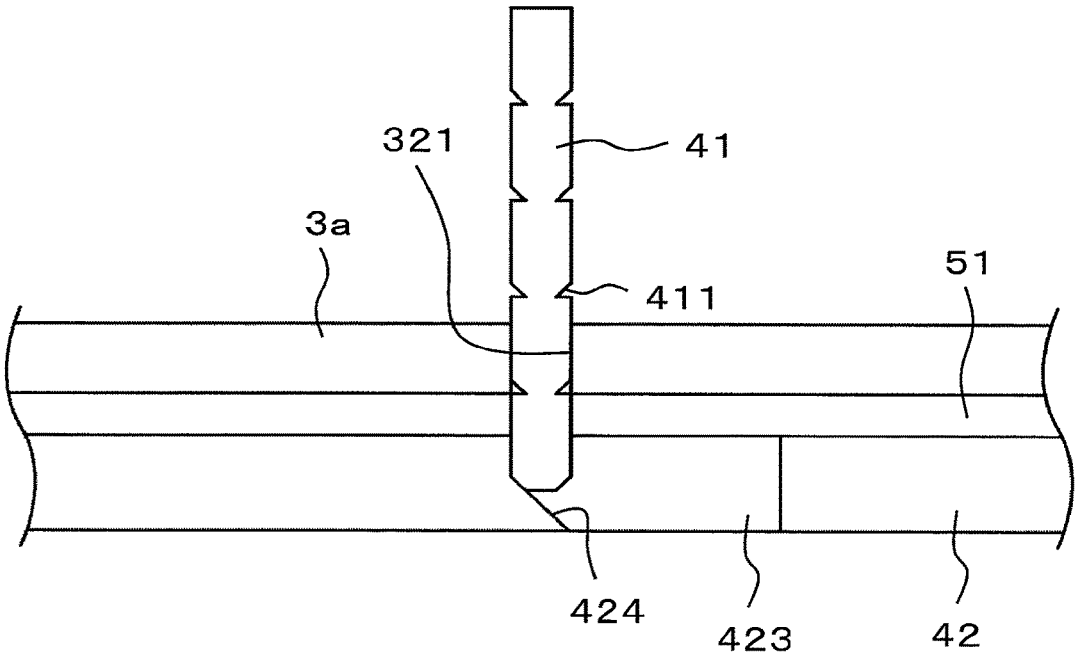
FIG. 16 is a sectional view on arrow taken along the line XVI-XVI of FIG. 15.
Figure 17:
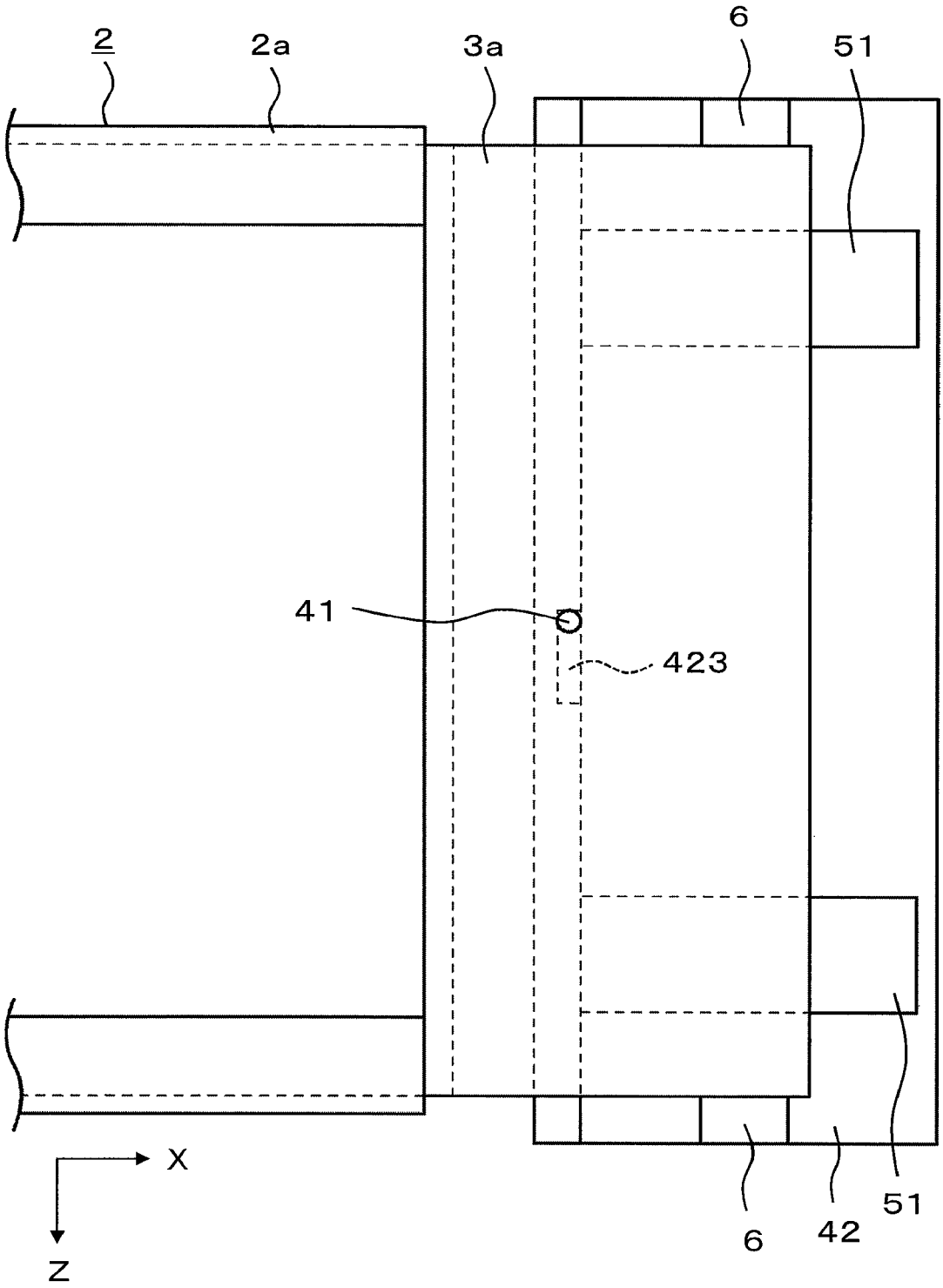
FIG. 17 is a plan view for illustrating the upper floor-side part of the escalator illustrated in FIG. 15.

FIG. 15 is a side view for illustrating an upper floor-side part of an escalator according to a fourth embodiment of the present invention, FIG. 16 is a sectional view on arrow taken along the line XVI-XVI of FIG. 15, and FIG. 17 is a plan view for illustrating an upper floor-side part of the escalator illustrated in FIG. 15. In the fourth embodiment, the anchor pin 52 is not provided, and the semi-fixing pin 41 fulfills the role of the anchor pin 52. The end portion of the backup plate 42 on the truss 2 side projects toward the truss 2 beyond the upper-side floor 1*a*. A dimension L1 between the longitudinal plate portion 31 of the support fitting 3*a* and the backup plate 42 is the same as the longitudinal dimension L1 between the longitudinal plate portion 31 of the support fitting 3*a* and the upper-side floor 1*a* in the first embodiment. In the first embodiment, the inclined surface 421 of the backup plate 42 is formed so as to be gradually separated from the truss 2 in the upward direction. Meanwhile, in the fourth embodiment, an elongated hole 423 extending in the width direction is formed in a portion of the backup plate 42, which projects toward the truss 2 beyond the upper-side floor 1*a*. An inclined surface 424 which is inclined to gradually approach another end portion in the width direction in a downward direction is formed at one end portion of an inner wall surface of the elongated hole 324 in the width direction.

The semi-fixing pin hole 321 into which the semi-fixing pin 41 is inserted is formed in the support fitting 3*a*. The radial dimension of the semi-fixing pin 41 is slightly smaller than the radial dimension of the semi-fixing pin hole 321. The strength of the semi-fixing pin 41 is such a strength as to allow the semi-fixing pin 41 to break under the load which is larger than the frictional force generated when the truss 2 is moved in the longitudinal direction with respect to the lower-side floor 1*b* and the inertia force of the truss 2 generated at the time of occurrence of the earthquake and is smaller than the buckling load of the truss 2.

The support fitting 3*a* does not have the elongated hole 322.

Similarly to the semi-fixing pin 41 of the first embodiment, downward movement of the semi-fixing pin 41 is restrained by the inclined surface 421 of the backup plate 42. In a case where a large-scale earthquake occurs, when the compression load acts on the truss 2, the semi-fixing pin 41 breaks before the buckling load of the truss 2 acts on the truss 2. The broken portion of the semi-fixing pin 41 falls while moving in the width direction along the inclined surface 424 of the backup plate 42. The remaining part of the semi-fixing pin 41 is moved in the longitudinal direction together with the support fitting 3*a*. When the building shakes in the negative direction to return the dimension L1 between the longitudinal plate portion 31 of the support fitting 3*a* and the backup plate 42 to the original dimension, the semi-fixing pin 41, which has been moved together with the support fitting 3*a*, returns to the original position under the self-weight. The remaining configuration is the same as those of the first to third embodiments.

As described above, in the escalator according to the fourth embodiment of the present invention, the anchor pin 52 is not provided, and the elongated hole 322 for insertion of the anchor pin 52 is not formed in the support fitting 3*a*. Therefore, as compared to the escalator according to the first embodiment, the structure can be more simplified. As other effects, the same effects as those obtained by the first embodiment can be obtained.

Fifth Embodiment

Figure 18:
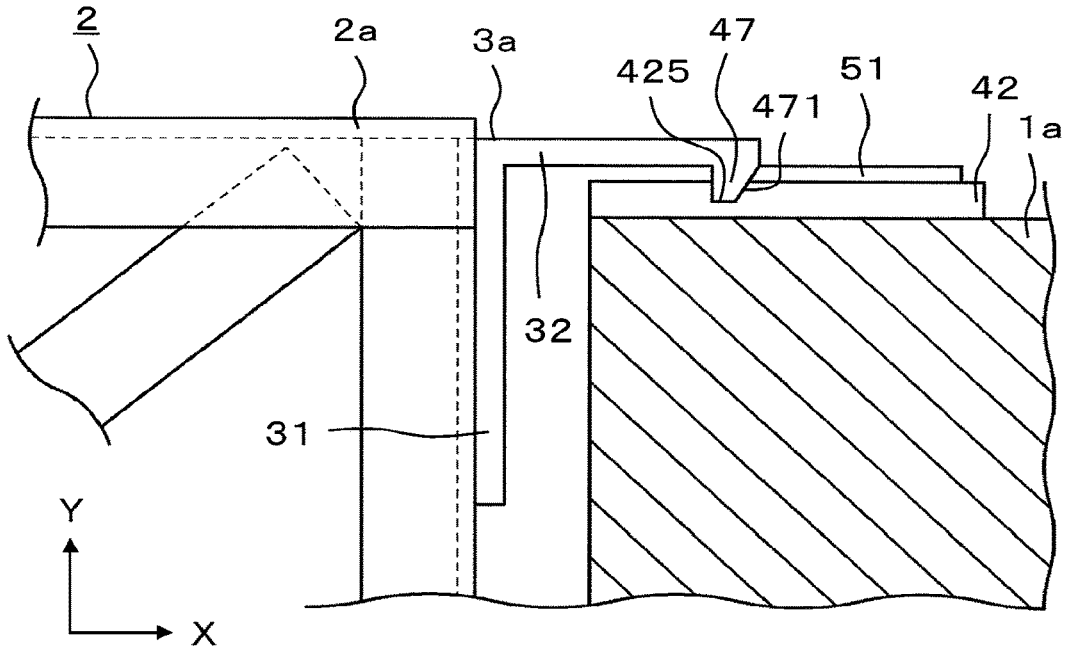
FIG. 18 is a side view for illustrating an upper floor-side part of an escalator according to a fifth embodiment of the present invention.

FIG. 18 is a side view for illustrating an upper floor-side part of an escalator according to a fifth embodiment of the present invention. The semi-fixing mechanism includes the backup plate 42 which is fixed onto the upper-side floor 1*a* and has a recess 425 formed in an upper surface thereof and a friction portion 47 which is formed on a lower surface of the support fitting 3*a* and is inserted into the recess 425. The friction portion 47 has an inclined surface 471 which is inclined with respect to the horizontal plane so as to be gradually separated from the truss 2 in an upward direction. The recess 425 has an inclined surface which is inclined with respect to the horizontal plane, similarly to the inclined surface 471. The sliding members 51 are arranged in regions which are farther from the truss 2 than the portion of the upper surface of the backup plate 42, in which the recess 425 is formed. The remaining configuration is the same as those of the first to fourth embodiments.

Figure 19:
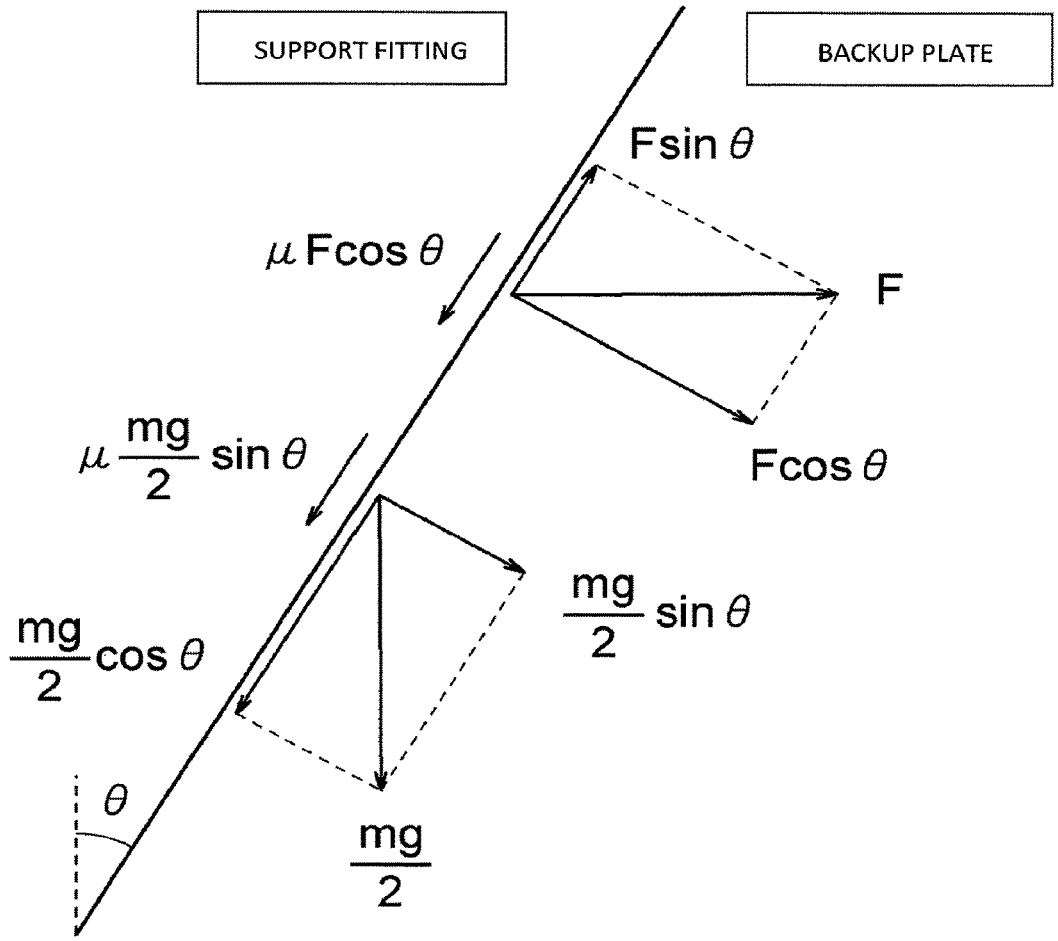
FIG. 19 is a diagram for illustrating equilibrium of forces at a friction portion illustrated in FIG. 18.

FIG. 19 is a diagram for illustrating equilibrium of forces at the friction portion 47 illustrated in FIG. 18. A force for releasing the restraint of the movement of the truss 2 to cause the truss 2 to start moving in the direction toward the upper-side floor 1*a* is determined by a friction coefficient μ of the friction portion 47 and an inclination angle θ of the inclined surface 471 of the friction portion 47 with respect to the horizontal plane. Assuming that half of a mass m of the truss 2 is supported on each of the unfixed side and the semi-fixed side, when the dimension between the upper-side floor 1*a* and the lower-side floor 1*b* becomes smaller than that at the time of installation to exert a compression load F on the truss 2, a condition under which the truss 2 is lifted up along the inclined surface 471 of the friction portion 47 is determined by Expression (1). It is noted that g is a gravitational acceleration.

$$F \sin\theta > \mu F \cos\theta + \mu mg/2 \times \sin\theta + mg/2 \times \cos\theta \qquad \text{Expression (1)}$$

When Expression (1) is rearranged for F, Expression (2) is obtained.

$$F > mg/2 \times (\mu \sin\theta + \cos\theta)/(\sin\theta - \mu \cos\theta) \qquad \text{Expression (2)}$$

The friction coefficient μ and the inclination angle θ are designed so that F expressed by Expression (2) becomes a load which is larger than the frictional force generated when the truss 2 is moved in the longitudinal direction with respect to the lower-side floor 1*b* and the inertia force of the truss 2 generated at the time of occurrence of the earthquake and is smaller than the buckling load of the truss 2.

FIG. 20 is a table for showing results of calculations of a relationship between the friction coefficient μ and the inclination angle θ when a self-weight mg of the truss 2 is assumed to be 100 kN. It is understood that, as the friction coefficient μ decreases and the inclination angle θ increases, the truss 2 is more liable to be lifted up along the inclined surface 471 of the friction portion 47. In the fourth embodiment, in a case where the buckling load of the truss 2 is 300 kN and the frictional force generated when the truss 2 is moved in the longitudinal direction with respect to the lower-side floor 1*b* and the inertia force of the truss 2 generated at the time of occurrence of the earthquake are 80 kN, it is assumed that the friction coefficient μ is 0.3 and the inclination angle θ is 30 degrees. Then, regardless of whether the dimension between the upper-side floor 1*a* and the lower-side floor 1*b* is increased or decreased after occurrence of a small- or moderate-scale earthquake, the friction portion 47 remains unmoved in the recess 425.

Figure 21:
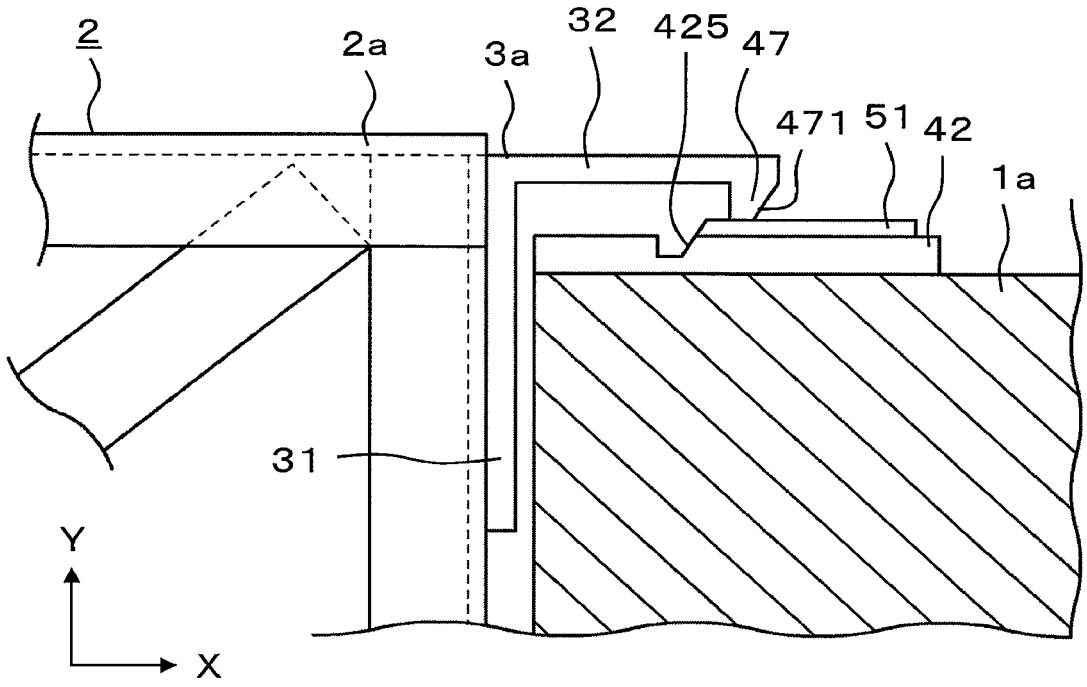
FIG. 21 is a side view for illustrating a state in which the friction portion illustrated in FIG. 19 is disengaged from a recess.

FIG. 21 is a side view for illustrating a state in which the friction portion 47 illustrated in FIG. 19 is disengaged from the recess 425. When the compression load F exerted on the truss 2 exceeds 212 kN, the truss 2 is lifted up along the inclined surface 471 to be moved over the sliding member 51. In this manner, 300 kN being the buckling load does not act on the truss 2. As a result, the dimension between the support fitting 3*a* and the support fitting 3*b* changes in response to the change in dimension between the upper-side floor 1*a* and the lower-side floor 1*b*. Thereafter, the dimension between the upper-side floor 1*a* and the lower-side floor 1*b* increases. Then, the friction portion 47 is inserted into the recess 425 to achieve the same state as that at the time of installation.

As described above, in the escalator according to the fifth embodiment of the present invention, as compared to the escalators according to the first to fourth embodiments which have the structure in which the number of times to allow the semi-fixing pin 41 to break to cause the semi-fixing mechanism to release the restraint of the truss 2 so as to automatically recover the position of the truss 2 is limited depending on the length of the semi-fixing pin 41, the limitation on the number of times of automatic recovery of the position of the truss depending on the length of the semi-fixing pin 41 can be eliminated.

Sixth Embodiment

Figure 22:
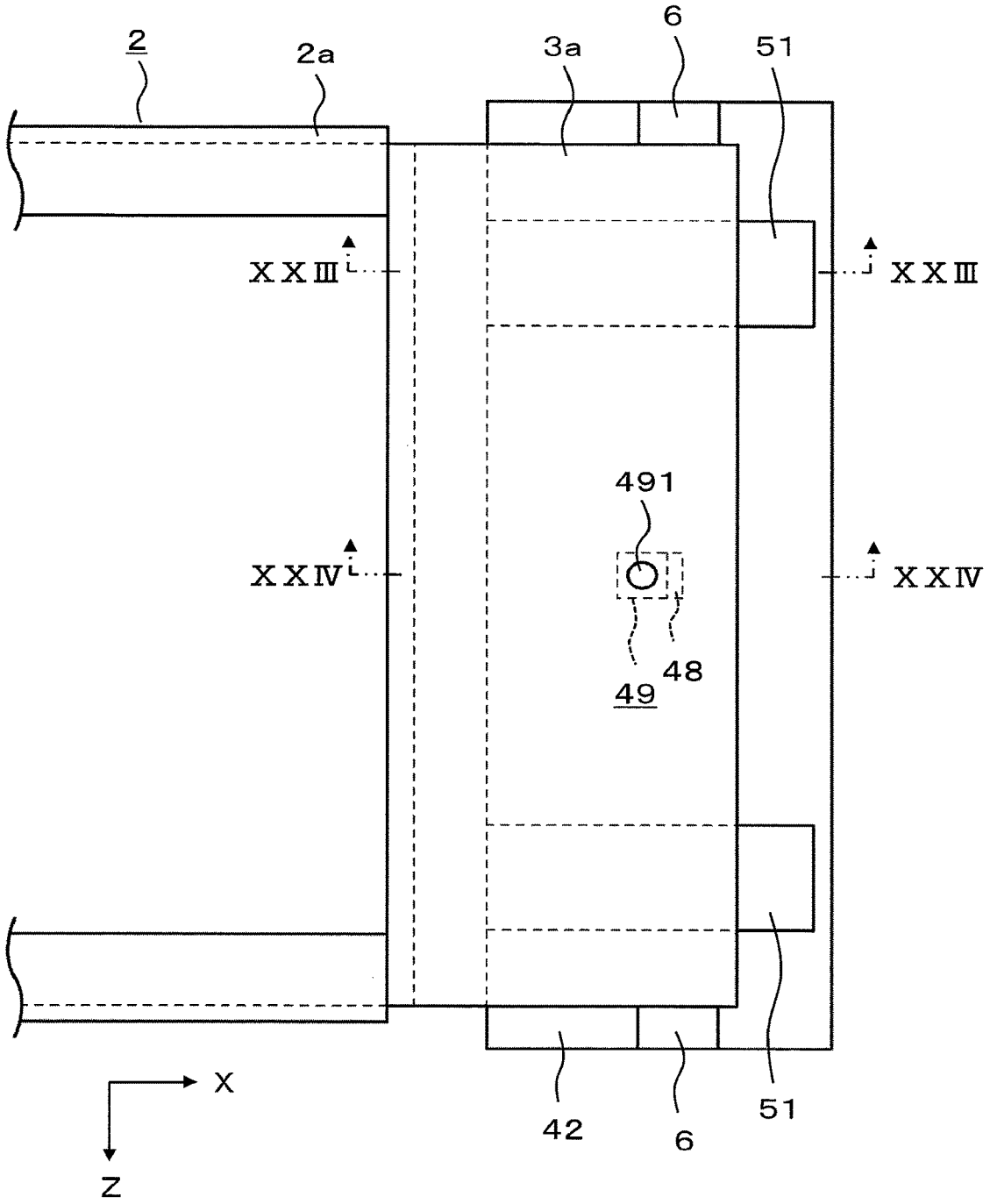
FIG. 22 is a plan view for illustrating an upper floor-side part of an escalator according to a sixth embodiment of the present invention.
Figure 23:
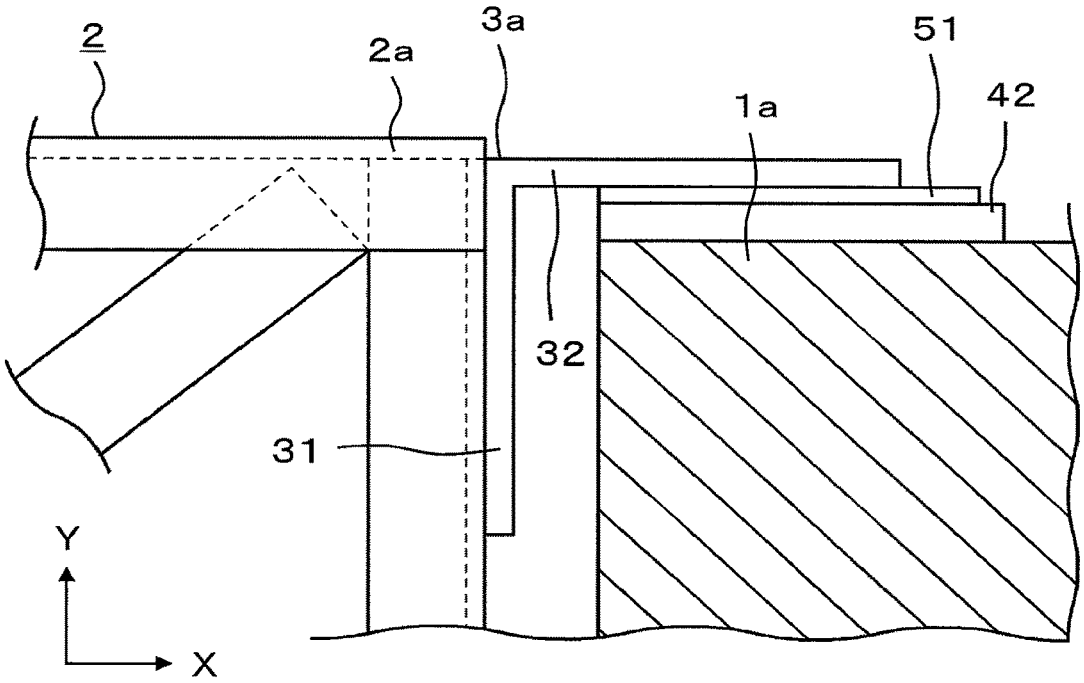
FIG. 23 is a sectional view on arrow taken along the line XXIII-XXIII of FIG. 22.
Figure 24:
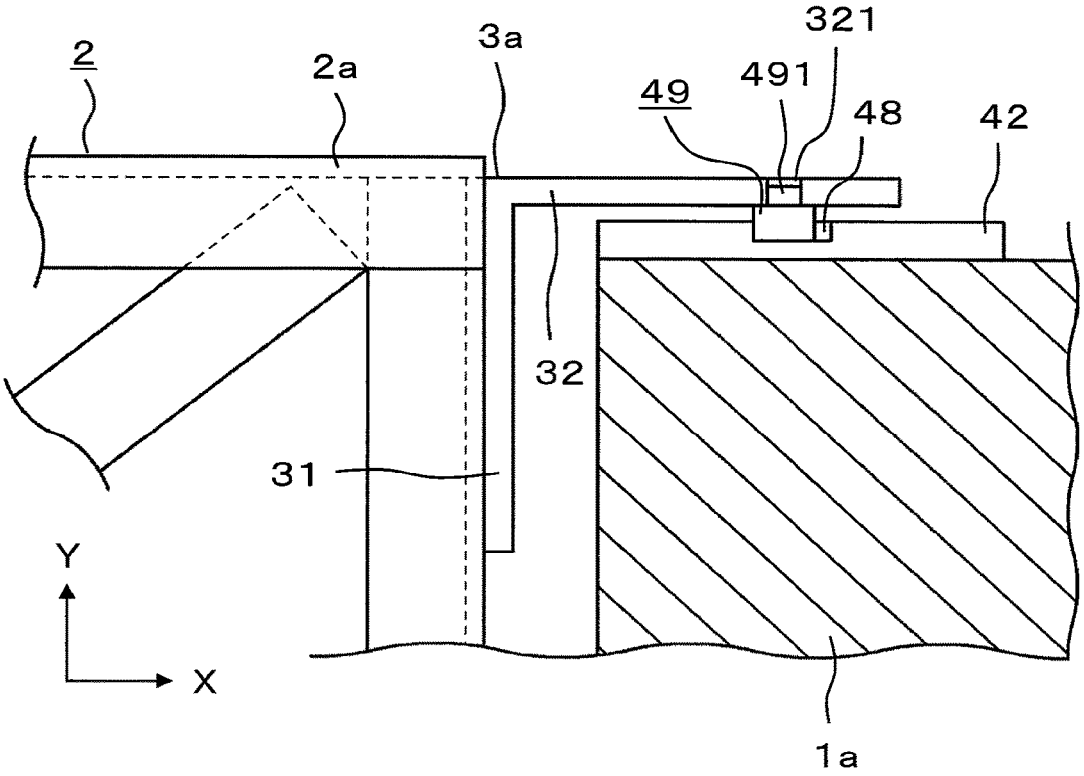
FIG. 24 is a sectional view on arrow taken along the line XXIV-XXIV of FIG. 22.

FIG. 22 is a plan view for illustrating an upper floor-side part of an escalator according to a sixth embodiment of the present invention, FIG. 23 is a sectional view on arrow taken along the line XXIII-XXIII of FIG. 22, and FIG. 24 is a sectional view on arrow taken along the line XXIV-XXIV of FIG. 22. The semi-fixing mechanism includes a force sensor 48 which is configured to detect the approaching force and an actuator 49 which includes a semi-fixing pin 491 being a restraining piece which is displaced between a restraining position at which the movement of the support fitting 3*a* in the longitudinal direction with respect to the upper-side floor 1*a* is restrained and a release position at which the restraint of the movement of the support fitting 3*a* in the longitudinal direction with respect to the upper-side floor 1*a* is released and is configured to displace the semi-fixing pin 491. The semi-fixing pin 491 has such a strength as not to allow the semi-fixing pin 491 to break even when the buckling load of the truss 2 acts thereon.

The actuator 49 includes a spring (not shown) which pushes up the semi-fixing pin 491 to displace the semi-fixing pin 491 to the restraining position during normal time. When the semi-fixing pin 491 is located in the restraining position, the semi-fixing pin 491 is inserted into the semi-fixing pin hole 321 formed in the support fitting 3*a*. The insertion of the semi-fixing pin 491 into the semi-fixing pin hole 321 restrains the movement of the support fitting 3*a* in the longitudinal direction with respect to the upper-side floor 1*a* to restrain the movement of the truss 2 in the longitudinal direction with respect to the upper-side floor 1*a*.

The actuator 49 attracts the semi-fixing pin 491 downward against a force of the spring to displace the semi-fixing pin 491 from the restraining position to the release position. When the semi-fixing pin 491 is located in the release position, the semi-fixing pin 491 is pulled out of the semi-fixing pin hole 321. The pull-out of the semi-fixing pin 491 from the semi-fixing pin hole 321 releases the restraint of the movement of the support fitting 3*a* in the longitudinal direction with respect to the upper-side floor 1*a* to release the restraint of the movement of the truss 2 in the longitudinal direction with respect to the upper-side floor 1*a*.

During normal time and when the small- or moderate-scale earthquake occurs, the actuator 49 displaces the semi-fixing pin 491 to the restraining position. When the small- or moderate-scale earthquake occurs, the dimension between the upper-side floor 1*a* and the lower-side floor 1*b* sometimes decreases and sometimes increases. However, the support fitting 3*a* is not moved in the longitudinal direction with respect to the upper-side floor 1*a*. As a result, the truss 2 is not moved in the longitudinal direction with respect to the upper-side floor 1*a*.

Meanwhile, when a large-scale earthquake occurs, the clearance between the longitudinal plate portion 33 of the support fitting 3*b* and the lower-side floor 1*b* is eliminated on the unfixed side. As a result, the compression load acts on the truss 2, and hence the force sensor 48 detects a load equal to or larger than the specified value. Based on a signal from the force sensor 48, the actuator 49 displaces the semi-fixing pin 491 from the restraining position to the release position. When the position of the semi-fixing pin 491 is displaced to the release position, the support fitting 3*a* is moved in the longitudinal direction with respect to the upper-side floor 1*a* to reduce the clearance between the longitudinal plate portion 31 of the support fitting 3*a* and the upper-side floor 1*a* even on the semi-fixed side. In this manner, the support fitting 3*a* is moved in the longitudinal direction with respect to the upper-side floor 1*a* in response to the change in dimension between the upper-side floor 1*a* and the lower-side floor 1*b*, thereby eliminating the compression load on the truss 2.

When the building starts shaking in the opposite direction, the dimension between the upper-side floor 1*a* and the lower-side floor 1*b* returns back to the original dimension. In this manner, the actuator 49 displaces the semi-fixing pin 491 from the release position to the restraining position. As a result, the escalator is automatically recovered into the original state. The remaining configuration is the same as those of the first to fifth embodiments.

As described above, the semi-fixing mechanism allows the semi-fixing pin 41 to break to release the restraint of the truss 2, and therefore the number of times of automatic recovery of the truss position is limited depending on the length of the semi-fixing pin 41 in the first to fourth embodiments. In the escalator according to the sixth embodiment of the present invention, however, the breakage of the semi-fixing pin 491 does not occur. Therefore, the limitation on the number of times of recovery can be eliminated.

In the sixth embodiment, the actuator 49 restrains the movement of the support fitting 3*a* in the longitudinal direction with respect to the upper-side floor 1*a* and releases the restraint of the movement of the support fitting 3*a* in the longitudinal direction with respect to the upper-side floor 1*a* by inserting and removing the semi-fixing pin 491 based on the signal from the force sensor 48. In addition to the insertion and removal of the semi-fixing pin 491, however, the actuator may, for example, sandwich the support fitting 3*a* like a disc brake to restrain the movement of the support fitting 3*a* in the longitudinal direction with respect to the upper-side floor 1*a* and to release the sandwiching of the support fitting 3*a* to release the restraint of the movement of the support fitting 3*a* in the longitudinal direction with respect to the upper-side floor 1*a*.

Although the escalator has been described as the passenger conveyor in each of the embodiments as an example, the passenger conveyor may be a moving walkway.

REFERENCE SIGNS LIST

1*a* upper-side floor, 1*b* lower-side floor, 2 truss, 2*a* one longitudinal end portion, 2*b* another longitudinal end portion, 3, 3*a*, 3*b* support fitting, 6 width-direction fastener, 31 longitudinal plate portion, 32 lateral plate portion, 33 longitudinal plate portion, 34 lateral plate portion, 41 semi-fixing pin, 42, 43 backup plate, 44 cylinder, 45 spring, 46 holding plate, 47 friction portion, 48 force sensor, 49 actuator, 51 sliding member, 52 anchor pin, 321 semi-fixing pin hole, 322 elongated hole, 323 semi-fixing pin hole, 411 cutout, 421 inclined surface, 422 elongated hole, 423 elongated hole, 424 inclined surface, 425 recess, 461 inclined surface, 471 inclined surface, 491 semi-fixing pin

The invention claimed is:

1. A passenger conveyor which is to be supported on one floor of a building through intermediation of one support fitting provided to one longitudinal end portion of a truss, is to be supported on another floor of the building through intermediation of another support fitting provided to another longitudinal end portion of the truss, and comprises a semi-fixing mechanism, which restrains movement of the truss in a direction toward the one floor and to release the restraint of the movement of the truss in the direction toward the one floor, the passenger conveyor comprising:

a truss-position recovery mechanism, which moves the truss in the longitudinal direction with respect to the one floor to set a dimension between the truss and the one floor to a preset specified dimension before the truss is moved in the longitudinal direction with respect to the another floor when a separating force in a direction in which the truss is separated from the one floor is exerted between the truss and the one floor after the restraint of the movement of the truss in the direction toward the one floor is released.

2. A passenger conveyor according to claim 1, wherein the semi-fixing mechanism restrains the movement of the truss in the direction toward the one floor when a magnitude of an approaching force exerted between the truss and the one floor in a direction in which the truss is moved toward the one floor is smaller than a preset specified value and releases the restraint of the movement of the truss in the direction toward the one floor when the magnitude of the approaching force is equal to or larger than the preset specified value.

3. A passenger conveyor according to claim 2, wherein the preset specified value is larger than a frictional force generated when the truss is moved in the longitudinal direction with respect to the another floor or an inertia force of the truss generated at a maximum earthquake, which is assumed based on design criteria, and is smaller than a buckling load of the truss.

4. A passenger conveyor according to claim 3, wherein the semi-fixing mechanism comprises:

a backup plate, which is fixed to the one floor and has a recess formed in an upper surface thereof; and a friction portion, which is provided to the one support fitting and is inserted into the recess, and wherein the friction portion has an inclined surface which is gradually separated from the one longitudinal end portion in an upward direction.

5. A passenger conveyor according to claim 4, wherein, when a friction coefficient of the friction portion is $\mu$, an inclination angle of the inclined surface with respect to a horizontal plane is $\theta$, a mass of the truss is m, and a gravitational acceleration is g, the friction coefficient and the inclination angle are determined so that a value obtained by: $mg/2\times(\mu \sin\theta+\cos\theta)/(\sin\theta-\mu\cos\theta)$ becomes equal to the preset specified value.

6. A passenger conveyor according to claim 1, wherein the semi-fixing mechanism comprises a semi-fixing pin to be inserted into a semi-fixing pin hole formed in the one support fitting, which restrains the movement of the truss in the direction toward the one floor, and wherein the semi-fixing mechanism allows the semi-fixing pin to break to release the restraint of the movement of the truss in the direction toward the one floor.

7. A passenger conveyor according to claim 6, wherein the semi-fixing mechanism comprises a backup plate, which is fixed to the one floor at a position lower than the semi-fixing pin hole and has an inclined surface inclined respect to a horizontal plane, and wherein the semi-fixing pin is supported on the backup plate by abutment of a lower end portion of the semi-fixing pin against the inclined surface.

8. A passenger conveyor according to claim 6, wherein the semi-fixing mechanism comprises:

a cylinder, into which a lower end portion of the semi-fixing pin is inserted;

a spring, which is provided to the cylinder and pushes the semi-fixing pin upward; and a holding plate, which is fixed to the one support fitting and restricts upward movement of the semi-fixing pin.

9. A passenger conveyor according to claim 1, wherein the semi-fixing mechanism comprises:

a force sensor, which is configured to detect the approaching force; and an actuator, which includes a restraining piece to be displaced between a restraining position at which movement of the one support fitting in the longitudinal direction with respect to the one floor is restrained and a release position at which the restraint of the movement of the one support fitting in the longitudinal direction with respect to the one floor is released and is configured to displace the restraining piece based on a result of detection by the force sensor.

10. A passenger conveyor according to claim 1, wherein the truss-position recovery mechanism comprises a sliding member, which is provided between the one floor and the one support fitting, and wherein, when the dimension between the truss and the one floor is smaller than the preset specified dimension after the restraint of the movement of the truss in the direction toward the one floor is released and the separating force is exerted between the truss and the one floor, the sliding member causes a frictional force generated when the one support fitting is moved in the longitudinal direction with respect to the one floor to be smaller than a frictional force generated when the another support fitting is moved in the longitudinal direction with respect to the another floor.

11. A passenger conveyor according to claim 1, wherein the truss-position recovery mechanism comprises a friction member, which is provided between the another floor and the another support fitting, and wherein, when the dimension between the truss and the one floor is smaller than the preset specified dimension after the restraint of the movement of the truss in the direction toward the one floor is released and the separating force is exerted between the truss and the one floor, the friction member causes a frictional force generated when the another support fitting is moved in the longitudinal direction with respect to the another floor to be larger than a frictional force generated when the one support fitting is moved in the longitudinal direction with respect to the one floor.

12. A passenger conveyor according to claim 1, wherein the truss-position recovery mechanism comprises an anchor pin, which is fixed to the one floor and is inserted into an elongated hole formed in the one support fitting to extend in the longitudinal direction, and wherein, when the separating force is exerted between the truss and the one floor and the dimension between the truss and the one floor is the preset specified dimension, the anchor pin is brought into abutment against a portion of an inner wall of the elongated hole, which is the farthest from the truss, to restrict the movement of the truss in the direction away from the one floor.

13. A method of fixing a passenger conveyor which is to be supported on one floor of a building through intermediation of one support fitting provided to one longitudinal end portion of a truss, is to be supported on another floor of the building through intermediation of another support fitting provided to another longitudinal end portion of the truss, and comprises a semi-fixing mechanism, which restrains movement of the truss in a direction toward the one floor and to release the restraint of the movement of the truss in the direction toward the one floor, the method comprising:

releasing the restraint of the movement of the truss in the direction toward the one floor; and moving the truss in the longitudinal direction with respect to the one floor to set a dimension between the truss and the one floor to a preset specified dimension before the truss is moved in the longitudinal direction with respect to the another floor when a separating force in a direction in which the truss is separated from the one floor is exerted between the truss and the one floor after the releasing of the restraint of the movement.

* * * * *